US011497944B2

(12) United States Patent
Wright et al.

(10) Patent No.: US 11,497,944 B2
(45) Date of Patent: Nov. 15, 2022

(54) DEVICE AND METHOD FOR BREACHING OUTWARD OPENING AND REINFORCED DOORS

(71) Applicant: CFD Research Corporation, Huntsville, AL (US)

(72) Inventors: Zachary William Wright, Bozeman, MT (US); William Christopher Krolick, Madison, AL (US); Wyatt Gilbert Ramos, New Braunfels, TX (US)

(73) Assignee: CFD Research Corporation, Huntsville, AL (US)

( * ) Notice: Subject to any disclaimer, the term of this patent is extended or adjusted under 35 U.S.C. 154(b) by 0 days.

(21) Appl. No.: 17/119,621

(22) Filed: Dec. 11, 2020

(65) Prior Publication Data

US 2021/0187332 A1 Jun. 24, 2021

Related U.S. Application Data

(60) Provisional application No. 62/947,458, filed on Dec. 12, 2019.

(51) Int. Cl.
*B25D 9/00* (2006.01)
*A62B 3/00* (2006.01)

(52) U.S. Cl.
CPC ..... *A62B 3/005* (2013.01)

(58) Field of Classification Search
CPC ..... A62B 3/005
USPC ..... 173/90, 91, 128
See application file for complete search history.

(56) References Cited

U.S. PATENT DOCUMENTS 3,577,881 A * 5/1971 Markovics ..... B21D 1/12 72/302
4,235,090 A * 11/1980 Wightman ..... B21D 1/06 72/479
5,067,237 A 11/1991 Holder
6,035,946 A * 3/2000 Studley ..... A62B 3/005 173/128
7,337,515 B2 3/2008 Phillips et al.
D570,655 S 6/2008 Meagher et al.
(Continued)

OTHER PUBLICATIONS

Dana Safety Supply; "Blackhawk! Dynamic Entry Mobile Home Door Breacher, Black DE-MHB"; Webpage; 2020 located at: https://danasafetysupply.com/blackhawk-dynamic-entry-mobile-home-door-breacher-black-de-mhb/ ; 3 pages.

*Primary Examiner* — Joseph J Hail
*Assistant Examiner* — Shantese L McDonald
(74) *Attorney, Agent, or Firm* — Maschoff Brennan

(57) ABSTRACT

A door breach device can include: an elongate shaft having a first end and an opposite second end; a pivot mechanism at the first end of the shaft; a spearhead rotatably coupled with the pivot mechanism and having a tip on a tip-side of the pivot mechanism and having a shaft cavity on a shaft-side, where the shaft cavity is adapted to receive the shaft therein; a restraint slidably received on the shaft-side of the spearhead and on the shaft; a handle protruding from the shaft; and a hitch at the second end of the shaft. A method of breaching a door can include: forcing the spearhead through a door until the restraint releases the spearhead and the spearhead rotates by the pivot mechanism so as to form an angle with the shaft; and pulling the spearhead against the door until the door is breached.

27 Claims, 24 Drawing Sheets

(56) References Cited

U.S. PATENT DOCUMENTS

| | | | | |
|---|---|---|---|---|
| D589,769 | S | 4/2009 | Timm et al. | |
| 7,707,700 | B1 * | 5/2010 | Lapetina | A62B 3/00 29/25 |
| 7,887,092 | B1 * | 2/2011 | Pacheco | A62B 3/005 280/762 |
| 7,900,538 | B2 | 3/2011 | Phillips et al. | |
| 8,197,257 | B2 | 6/2012 | Clewis | |
| 8,935,839 | B2 | 1/2015 | Burt | |
| 9,318,028 | B1 | 4/2016 | Ingesson et al. | |
| 9,569,980 | B2 | 2/2017 | Phillips et al. | |
| 9,821,175 | B2 | 11/2017 | Dapkins et al. | |

* cited by examiner

DEVICE AND METHOD FOR BREACHING OUTWARD OPENING AND REINFORCED DOORS

CROSS-REFERENCE TO RELATED APPLICATIONS

This patent application claims priority to U.S. Provisional Application No. 62/947,458 filed Dec. 12, 2019, which provisional is incorporated herein by specific reference in its entirety.

BACKGROUND

Field

The present disclosure relates to a device for breaching outward opening and reinforced doors.

Description of Related Art

Previously, outward opening door breaching mechanisms can be categorized as follows: (1) prying mechanisms; (2) explosive mechanisms; (3) ballistic mechanisms; and (4) puncture mechanisms. Prying mechanisms use leverage and a slim wedge to attempt to crack open the door at its opening/lock point. The disadvantages of the prying technique are that it can be time consuming and ineffective depending on the type of door and lock. The time to perform the prying may take too long to use during hostage or other scenarios where quick action without alerting bad actors is important. Explosive mechanisms use strategically located preset explosives to eliminate the doors hinges and or locks. While using explosives is the preferred method amongst qualified professionals, the potential blast effects from the explosives have been shown to be extremely dangerous for the breach team (e.g., repeated blast exposure may cause traumatic brain injury). The problems with explosives are even more serious when considering hostages or victims on the other side of the door inside the blast zone who are unprepared and unprotected. Also, explosive set up can be time consuming and a botched explosive breach can lead to a blocked entry point. Ballistic mechanisms use specifically modified firearms (e.g., shotguns) to eliminate the lock. While potentially the quickest breach tactic, it is more applicable to a lighter door as opposed to a reinforced steel door. Puncture mechanisms push through the door in some manner to attempt to open the door from the inside out. This method is preferable because it can eliminate the door hinge/lock type dependent effectiveness while utilizing leverage to quickly breach the door, but is also mechanical in nature so there are no harmful blast effects.

U.S. Pat. No. 5,067,237 discloses a battering ram with a tip that can puncture a door. Most other door breach associated patents relate to a reusable door system for breach training (e.g., U.S. Pat. Nos. 9,569,980, 9,318,028, 8,197,257, etc.) rather than a breach tool itself. Some examples of pry-type devices can include U.S. Pat. Nos. 7,337,515 and 9,821,175. Standard battering rams are exemplified by U.S. Pat. Nos. 7,900,538 and 8,935,839 as well as design patents U.S. Pat. No. D570655 and U.S. Pat. No. D589769 There are several related commercially available products (e.g., BLACKHAWK! TACTICAL Dynamic Entry® Mobile Home Door Breacher and Breaching Technologies Inc. Crook Hook).

Thus, there is a need for an improved tool for breaching doors, such as outward opening and reinforced doors.

SUMMARY

In some embodiments, a door breach device can include: an elongate shaft having a first end and an opposite second end; a pivot mechanism at the first end; a spearhead rotatably coupled with the pivot mechanism, the spearhead having a tip on a tip-side of the pivot mechanism and having a shaft cavity on a shaft-side, where the shaft cavity is adapted to receive the shaft therein; a restraint configured to be slidably received on the shaft-side of the spearhead and on the shaft when received into the shaft cavity; and a hitch at the second end of the shaft.

In some embodiments, a door breach device can include: an elongate shaft having a first end and an opposite second end; a pivot mechanism at the first end of the shaft; a spearhead rotatably coupled with the pivot mechanism, the spearhead having a tip on a tip-side of the pivot mechanism and having a shaft cavity on a shaft-side, where the shaft cavity is adapted to receive the shaft therein; a restraint configured to be slidably received on the shaft-side of the spearhead and on the shaft when received into the shaft cavity; a handle protruding from the shaft; and a hitch at the second end of the shaft.

In some embodiments, a door breach device can include: an elongate shaft having a first end and an opposite second end; a pivot mechanism at the first end; a spearhead rotatably coupled with the pivot mechanism, the spearhead having a tip on a tip-side of the pivot mechanism and having a shaft cavity on a shaft-side, where the shaft cavity is adapted to receive the shaft therein; a restraint configured to be slidably received on the shaft-side of the spearhead and on the shaft when received into the shaft cavity; and a hitch aperture at the second end of the shaft.

In some embodiments, a kit can include: the door breach device of one of the embodiments; and a tow member adapted to be coupled to a hitch aperture.

In some embodiments, a kit can include: the door breach device of one of the embodiments; and a post rammer having an open end and internal chamber adapted to be fit over the hitch. The post rammer has a solid or blocked end opposite of the open end, which blocked end is adapted to ram against the hitch.

In some embodiments, a method of breaching a door can include: obtaining a door breaching device or kit of one of the embodiments; forcing the spearhead through a first side of the door until the restraint releases the spearhead and the spearhead rotates by the pivot mechanism so as to form an angle with the shaft; and pulling the spearhead against a second side of the door until the door is breached.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1A:
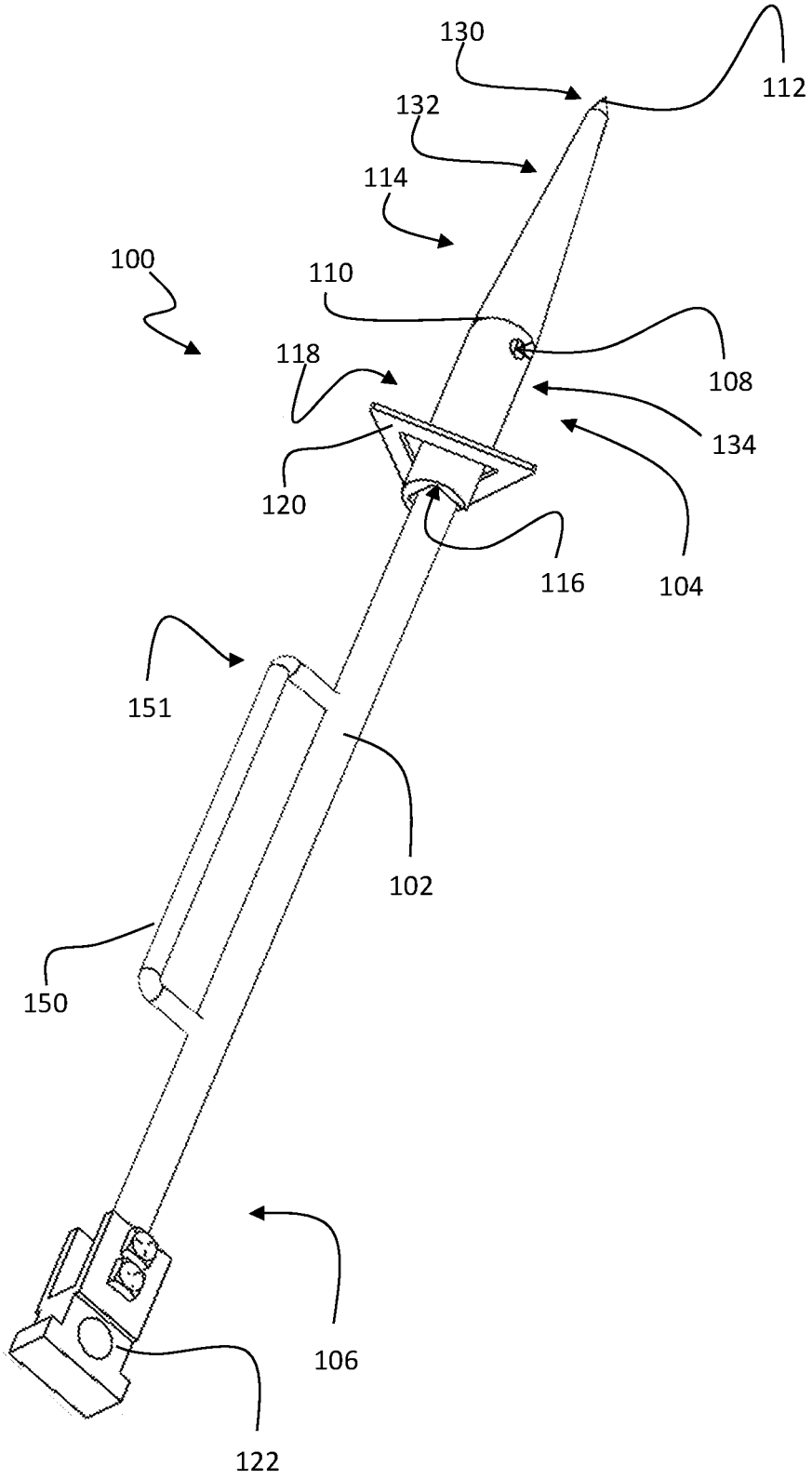
FIGS. 1A-1C illustrate an embodiment of a door breach device in different stages of use.

The elements and components in the figures can be arranged in accordance with at least one of the embodiments described herein, and which arrangement may be modified in accordance with the disclosure provided herein by one of ordinary skill in the art.

The dimensions shown in some of the figures can vary with design and for different uses, and thereby the dimensions are a guide to an embodiment. However, the dimensions can rage from +/−1%, 2%, 5%, 10%, 15%, 20%, 25%, 50%, 75%, 100% or more.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Generally, the present technology includes a mechanical tool (e.g., door breach device) that is configured to breach heavy-duty doors and outward opening doors. The door breach device is configured to be capable of puncturing a door (e.g., steel door) by including a spearhead that is shaped and weighted with the proper materials. The door breach device is configured to be capable of deploying a brace that is formed by the spearhead once it pivots after being pushed through the punctured door, where the spearhead is weighted to use gravity in order to be deployed as a brace. The door breach device is configured to be capable of pulling the punctured door so as to breach a door by the deployed spearhead functioning as a brace and pulling on the door breaching device in the direction opposite of the puncturing force. The door can be breached by pulling it off of its hinges or by breaking the door to allow entry into the doorway. The door breach device can also be used in any manner to open a door to allow entry or otherwise clearing a breach point to allow entry.

In some embodiments, the spearhead is mounted to a rotational pivot mechanism and retained in a puncture configuration to allow for puncturing through a door. Then, the retainer is moved by the door off of the spearhead in order to use gravity to rotate and deploy the spearhead from the puncture position to the breach position in order for the spearhead to function as a brace in order to breach outward opening or reinforced doors. The door breach device provides for a modularity and scalability that offers many variations on the basic design for different applications. For example, a smaller single user tool can be constructed for the specific application of residential storm doors, which often offer the additional inconvenience of a second wooden inward opening door behind them. A similar or even lighter design can also be constructed for the application of outward opening more lightly constructed doors or wooden doors. Larger and robust designs can be used for reinforced doors, whether opening inwardly or outwardly (e.g., especially for outward opening doors).

The door breach device can provide a rapid door breach with minimal effort and no explosives, while minimizing health risks for law enforcement or special operations response teams in scenarios where traditional breach methods are ineffective. The door breach device is particularly useful for doors that have been traditionally difficult to breach, such as doors that have an outward opening and structurally reinforced doors. In fact, these types of doors are particularly suited for breaching by a pull-force breach. Previously, push-force rams (e.g., battering ram), pry-type devices, or explosives have been used for such doors, with the complications of push-force rams being difficult to push a door through a door jamb stop and explosives being undesirable. In fact, the outward opening doors can now be breached with the door breach device because the door jamb stop provides a brace function that allows the spearhead of the door breach device to penetrate the door while resisting the force applied. Once penetrated, the spearhead deploys into a brace, and the door breach device can be pulled (e.g., opposite force from the puncture force) by the hitch to pull the door from the door jamb, such as by pulling the door off of its hinges. The door breach device can also be pulled against any type of door in order to deform or break the door, where the deformed or broken door can be extricated.

The door breach device can also be used on inwardly opening doors, such as by being used as a battering ram and/or deforming or breaking the door during application of the pulling force. In addition to penetrating the door body, the door breach device can be used to penetrate a door handle or the region where the deadbolt or door knob mechanism is located in order to disrupt the function that retains the door in a closed and locked position. That is, the lock can be punctured and disabled and deformed to allow for the door to become unlocked, which can then allow for the door to be breached.

Outward opening doors and structurally reinforced doors are common on commercial buildings. Also, there are a number of different types of outward opening residential doors (e.g. storm doors) that are inconvenient to breach.

The door breach device can be used by various government (e.g., police, military, FBI, CIA, DHS, etc.) personnel in scenarios that require a door to be breached quickly and effectively, such as scenarios involving a hostage, trapped victim, drug bust, and terrorism related situations in the environments that lend themselves to the use of the presented door breach device and related technology.

In some embodiments, the door breaching tool includes a dual-purpose spearhead that both punctures the door and then uses gravity to automatically deploy to a "T" shaped brace on the other side. The deployed spearhead provides a large surface area and leverage for the breaching of doors, such as reinforced doors and/or outward opening doors.

In some embodiments, the door breaching device includes a hitch attached to the back of the shaft. The hitch provides a location for the application of both puncture force (e.g., push force) and removal force (e.g., pull force). The hitch is configured to allow for both types of forces to be applied by a variety of approaches, including battering ram or post rammer type devices for the puncture force, and including vehicle or winch type devices for the removal force. The door breaching device represents a significant advancement in breaching technology, and can provide increased situational adaptability to tactical operations teams in difficult scenarios that traditional breaching methods are ineffective for.

Figure 1B:
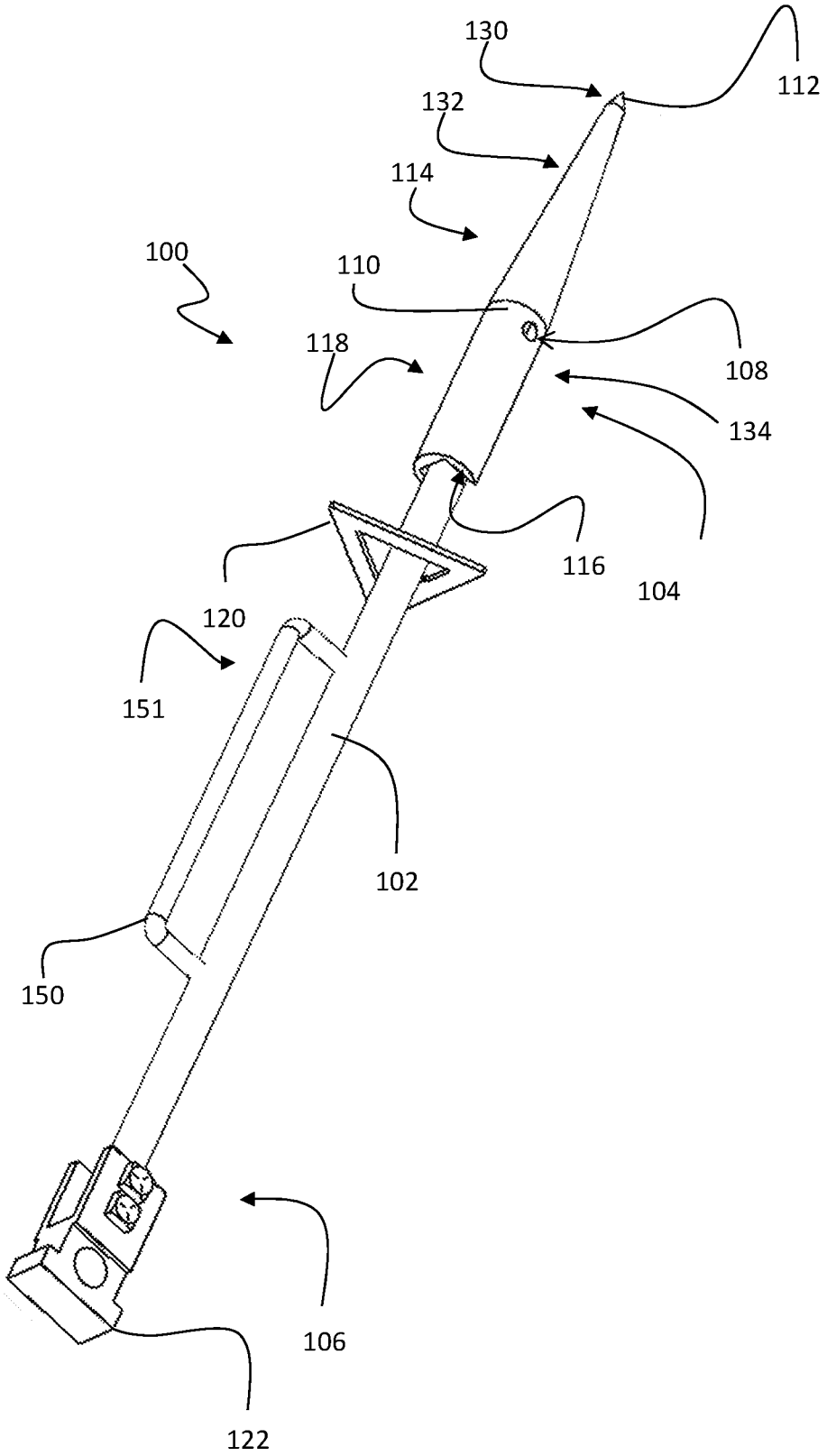
Figure 1C:
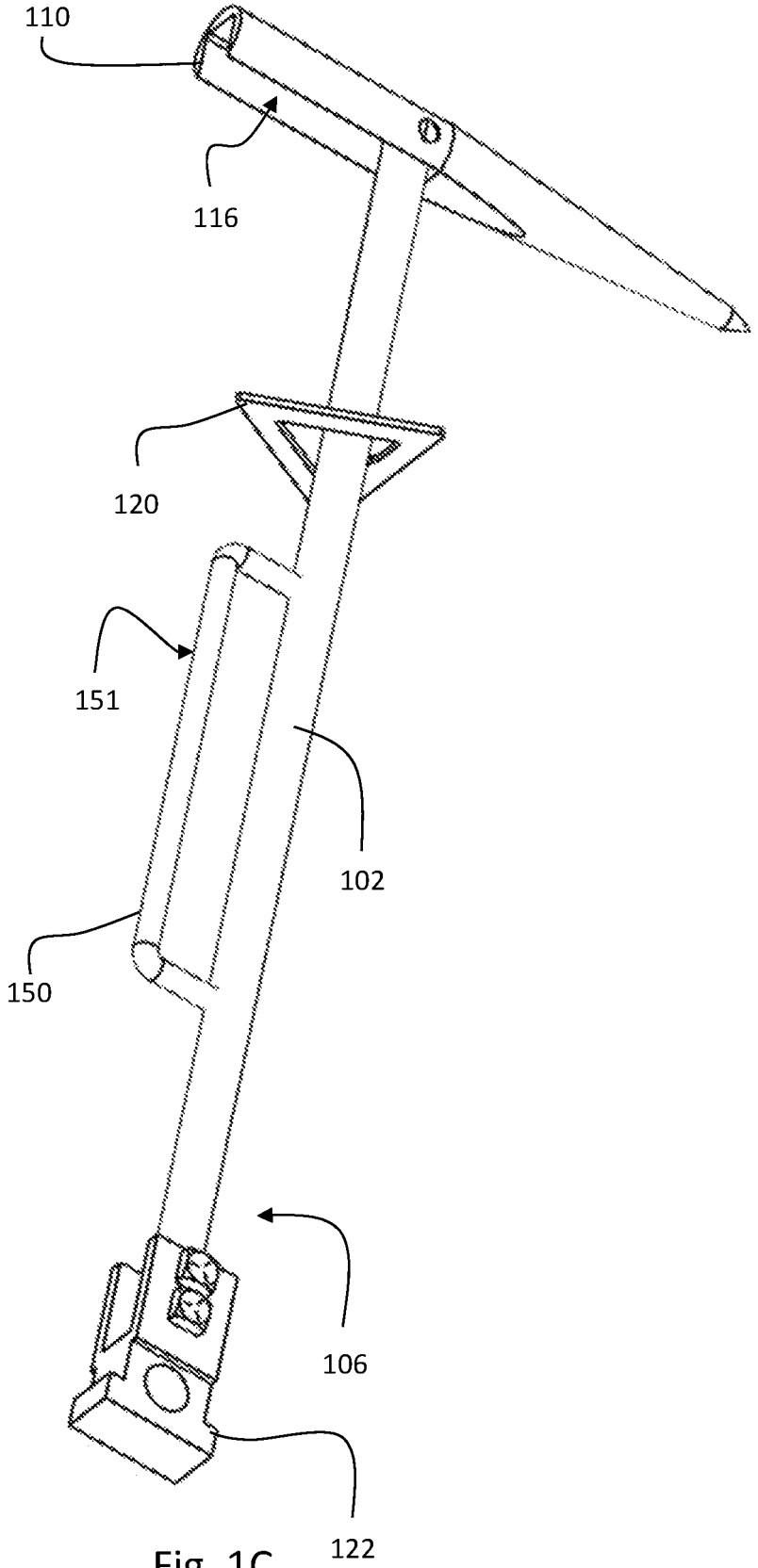

FIGS. 1A-1C illustrate a door breach device 100 in a puncture configuration (FIG. 1A), a transitional configuration (FIG. 1B, with restraint 120 removed from spearhead 110), and in a breach configuration (e.g., FIG. 1C). FIG. 2 shows an exploded view of the door breach device 100.

The door breach device 100 is shown to include an elongate shaft 102 having a first end 104 and an opposite second end 106. A pivot mechanism 108 is located at the first end 104. A spearhead 110 is rotatably coupled with the pivot mechanism 108. The spearhead 110 has a tip 112 on a tip-side 114 of the pivot mechanism 108 and has a shaft cavity 116 on a shaft-side 118 of the pivot mechanism 108. The shaft cavity 116 is adapted to receive the shaft 102 therein, such that the shaft 102 and spearhead 110 can rotate relative to each other. The door breach device 100 includes a restraint 120 that is configured to be slidably received on the shaft-side 118 of the spearhead 110 and slidably received on the shaft 102 when the shaft 102 is received into the shaft cavity 116 or slidable on the shaft 102 after the spearhead 110 has rotated off of the shaft 102 (e.g., shaft 102 no longer in the shaft cavity 116). The door breach device 100 can also include a hitch 122 at the second end 106 of the shaft 102.

The illustrated door breach device 100 can also be configured to include: an elongate shaft 102 having a first end 104 and an opposite second end 106; a pivot mechanism 108 at the first end 104; a spearhead 110 rotatably coupled with the pivot mechanism 108, the spearhead 110 having a tip 112 on a tip-side 114 of the pivot mechanism and having a shaft cavity 116 on a shaft-side 118, where the shaft cavity 116 is adapted to receive the shaft 102 therein; a restraint 120 configured to be slidably received on the shaft-side 118 of the spearhead 110 and on the shaft 102 when received into the shaft cavity 116; a handle 150 protruding from the shaft 102; and a hitch 122 at the second end 106 of the shaft 102.

The door breaching device 100 is a tool configured to be capable of puncturing a door, deploying the spearhead 110 into a brace "T" shape", and remove outward opening and heavy duty doors. The shaft 102 is the connecting part for all other parts of the tool. The spearhead 110 is the puncturing and deploying part (e.g., deploy into a brace) of the tool. The pin 128 that is the pivot point (e.g., pivot mechanism 108) of the spearhead 110 also functions for connecting the spearhead 110 to the shaft 102. The restraint 120 is shaped to hold the spearhead 110 parallel to the shaft 102 in the puncture configuration until in use and a door pushes against the restraint 120 so that a restraint 120 slides along the shaft 102 toward the second end 106, such as toward the handle 150 or hitch 122, thereby allowing the spearhead 110 to rotate and deploy into the brace "T" shape. The hitch 122 provides the portion of the device that allows for receiving the puncture force (e.g., when applied by a device, the handle 150 is used to apply puncture force by a human) and removal force, by providing an application point and is attached to the second end 106 of the shaft 102 at the opposite end from the spearhead 110. One or more handles 150 are attached to the shaft 102, about near the center of gravity. The one or more handles 150 are used to safely hold the door breach device 100 in place during the puncturing procedure. The one or more handles 150 can also be used to protect the users' hands from being smashed during puncturing of the door during the door breach protocol. The one or more handles 150 can also function to stop the door breach device 100 from penetrating an unnecessary amount through the door. The one or more handles 150 can also function to allow a human user to swing the door breach device 100 into a door, such that the spearhead 110 can puncture some types of doors without additional force being applied to the hitch 122.

Figure 10A:
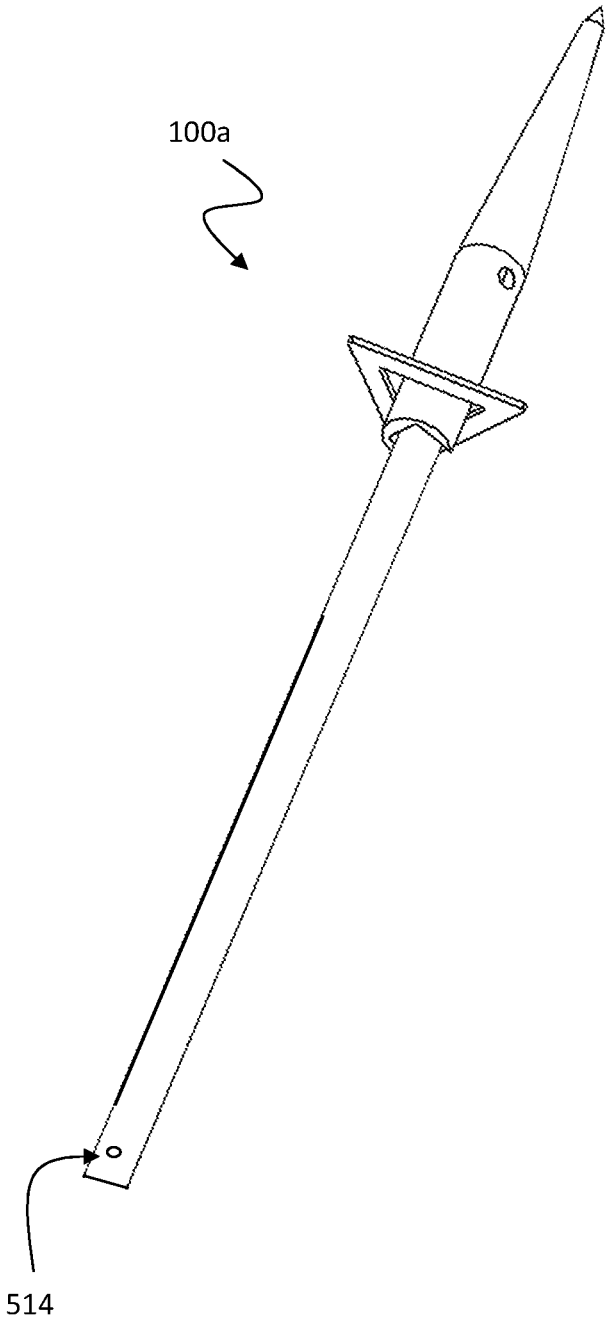
FIG. 10A illustrates an embodiment of a door breach device.
Figure 10B:
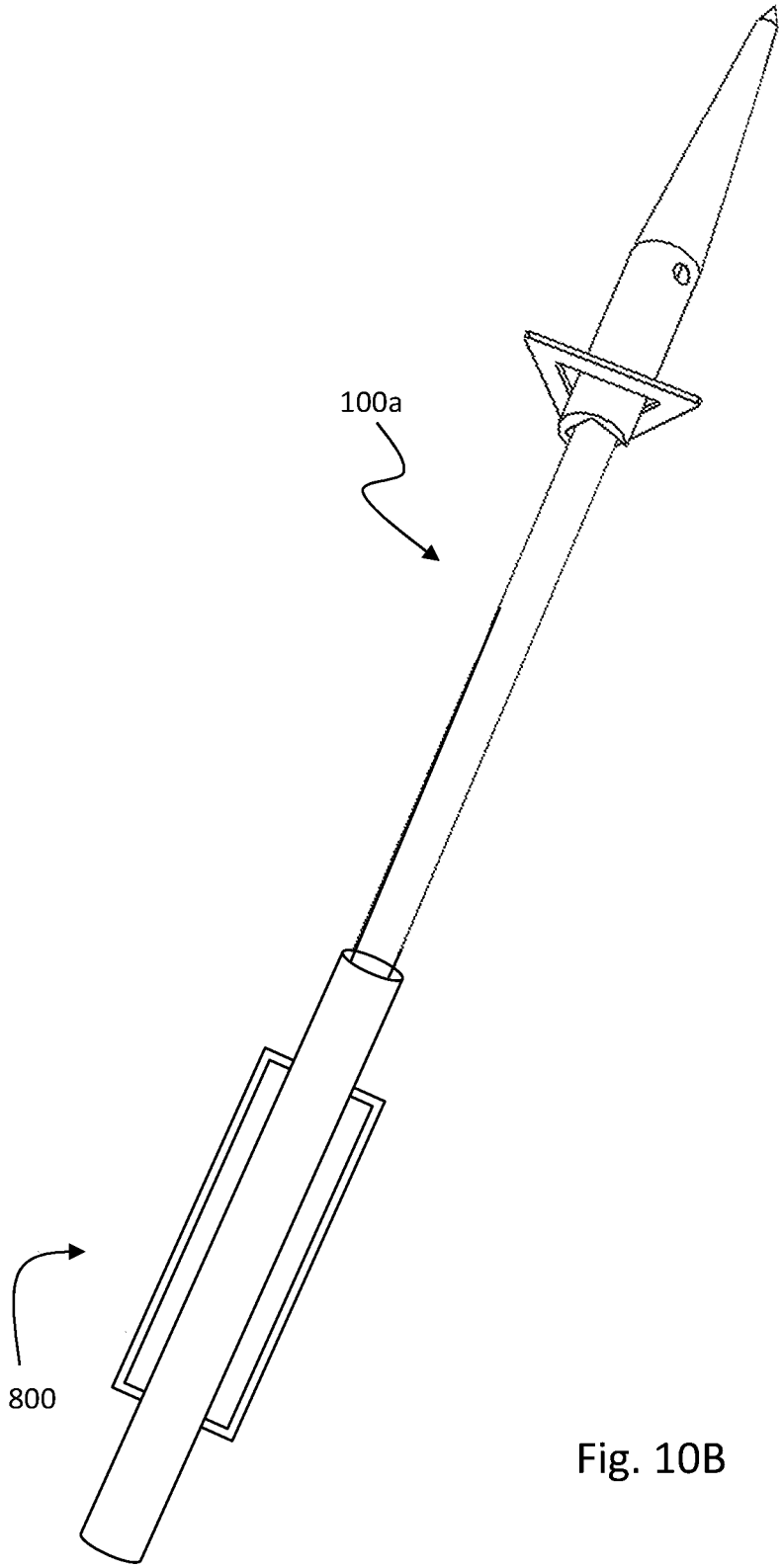
FIG. 10B illustrates an embodiment of a door breach device being used with a post rammer.

FIG. 10A also shows another embodiment of a door breach device **100*a* comprising: an elongate shaft 102 having a first end 104 and an opposite second end 106; a pivot mechanism 108 at the first end 104; a spearhead 110 rotatably coupled with the pivot mechanism 108, the spearhead 110 having a tip 112 on a tip-side 114 of the pivot mechanism 108 and having a shaft cavity 116 on a shaft-side 118, where the shaft cavity 116 is adapted to receive the shaft 102 therein; a restraint 120 configured to be slidably received on the shaft-side 118 of the spearhead 110 and on the shaft 102 when received into the shaft cavity 116; and a hitch aperture 514 at the second end 106 of the shaft 102. Here, the hitch 122 is omitted and the hitch aperture 514 is included in the shaft 102. The second end 106 may have a blunt end or be otherwise configured to function as a hitch. Also, with or without the hitch 122, the door breach device 100*a* can be included with a kit (e.g., used with) a post rammer 800 as shown in FIG. 10B**.

Figure 1D:
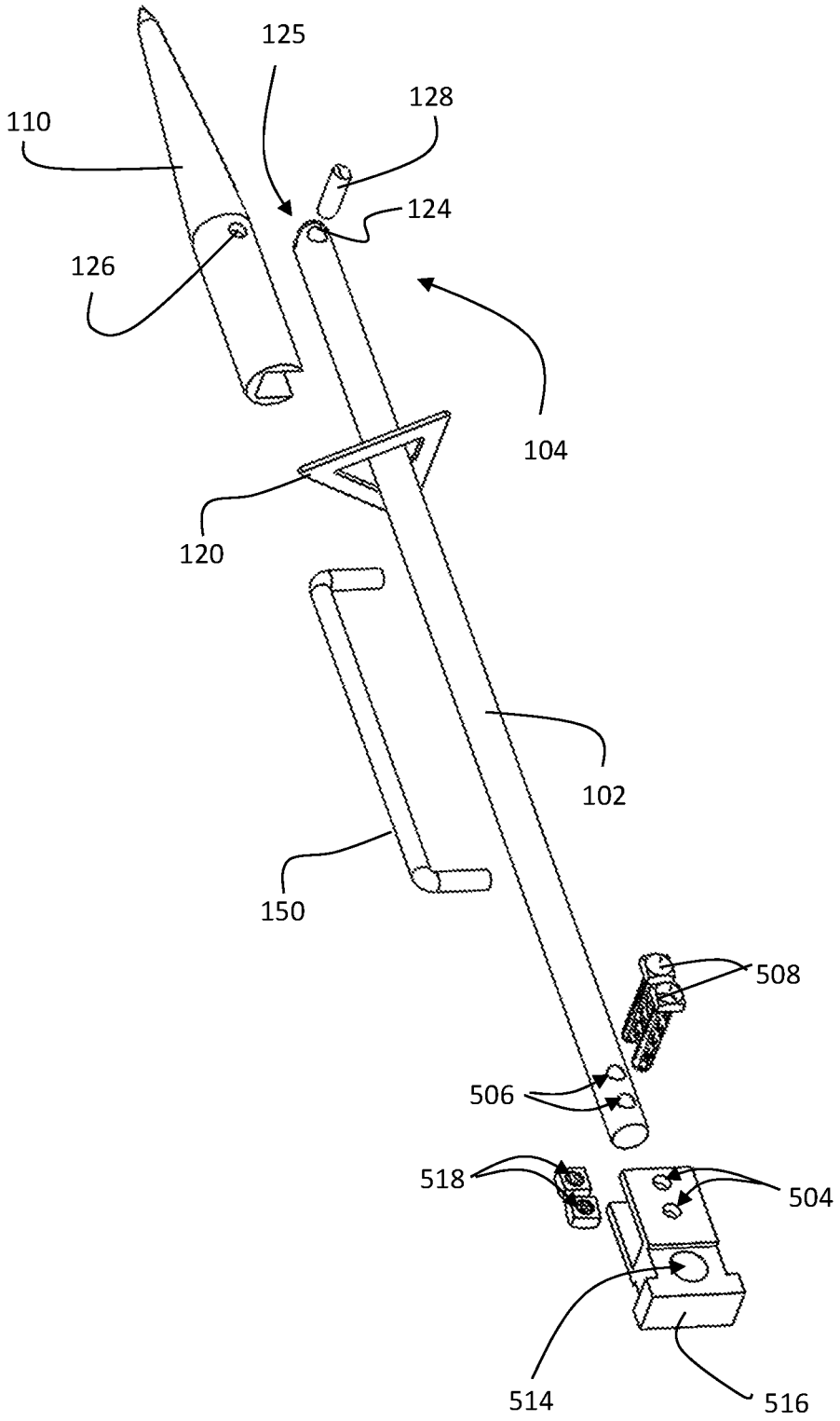
FIG. 1D illustrates an exploded view of the door breach device of FIGS. 1A-1C.

As shown in FIG. 1D, the first end 104 of the shaft 102 includes a shaft pin aperture 124 adjacent to the rounded end 125. The rounded end 125 has a rounded surface that allows for the rotation of the spearhead 110, and thereby the arc of the curve of the rounded end 124 identifies the rotational direction. Correspondingly, the spearhead 110 includes at least one spearhead pin aperture 126. A pin 128 is located in the shaft pin aperture 124 and the at least one spearhead pin aperture 126 so as to form the pivot mechanism 108. This allows for the spearhead 110 to rotate relative to the shaft 102 unless retained in the puncture configuration by the restraint 120. Accordingly, the spearhead 110 is connected to the shaft 102 with the pin 128 that fits into holes 124, 126 that run entirely through the un-tapered section (e.g., brace portion 134) of the spearhead 110 and the first end 104 of the shaft 102. The first end 104 of the shaft 102 is covered or overlapped by the brace portion 134 of the spearhead 116 when in the puncture configuration. The second end 104 of the shaft 102 is removed from the spearhead 110 once it rotates to the breach configuration (e.g., shaped as a brace). While the device is illustrated and described to be cylindrical, which includes a circular cross-sectional profile, it should be recognized that the different features and elements may have cross-sectional profiles that are not circular or oval, but instead may be triangular, square, rectangular, or other polygon cross-sectional profile shape. As such, the spearhead 100 and shaft 102 may have any suitable cross-sectional profile shape. Particularly, the shaft 102 and brace portion 134 may have a cross-sectional profile that is a shape other than circular or oval.

The through holes 124, 126 that the pin 128 fits through to connect the shaft 102 to the spearhead 110 is located near the end of the shaft cavity 116 (e.g., channel) and slightly offset in the vertical direction (e.g., with respect to gravity when the shaft 102 is horizontal). However, the through holes 124, 126 may be centered or at any suitable location in the body of the body of the shaft 102 and/or spearhead 110. The pin 128 is set in place inside the spearhead 110 through the holes 124, 126. This is achieved by any number of effective methods, such as an interference fit or a smoothed tack weld (e.g., to the spearhead 110 on the outside). The pin 128 is machined to be smooth against the surface of the holes 124, 126 once set. The holes 124, 126 are far enough away from the end of the shaft cavity 116 to allow the spearhead 110 to rotate without interference from the shaft 102, but close enough to the end (e.g., shaft cavity end wall 408) of the shaft cavity 116 to allow for close to even distribution of weight and/or length on either side of the holes 124, 126 to best breach the door, discussed below. The offset of the hole 126 in the spearhead 110 in the vertical direction (e.g., away from the edge of the bottom surface 412) is set to increase the thickness of the thinnest section (e.g., the edges of the shaft cavity 116) so that the material will withstand the pulling force, but not so much that the shaft cavity 116 no longer encompasses the entirety of the shaft 102. In an embodiment where the brace portion 134 overlaps the first end 104 of the shaft 102 (e.g., brace portion 134 does not fully cover the first end 104, but provides an overlap of these two members), the hole 126 may be centered or offset.

The pin 128 is a rotational and load bearing axel that is designed to withstand repeated door breaching puncture and removal bending/shear forces. The pin diameter is about 0.75 inches, but can significantly depend on the application of the door breach device 100. The pin diameter can range from about 0.25 inches to about 2.5 inches, from about 0.5 inches to about 2 inches, from about 0.7 to about 1 inch. The pin length is defined by the outer diameter of the spearhead 110 (e.g., about 2.5 inches), which can vary depending on the type of door that will be breached with the tool, such as about 1 inch to about 5 inches, about 1.25 inches to about 4 inches, about 1.5 inches to about 3 inches, about 2 inches to about 2.75 inches, or about 2.5 inches. The pin 128 is dimensioned relative to the spearhead 110 maximum outer diameter so as to be close to or exactly flush with the outer diameter of the spearhead 110. The shaft 102 is connected to the spearhead 110 with the pin 128 that is inserted through aligned holes 124, 126 in the spearhead 110 and shaft 102.

In some embodiments, the pin 128 rotates freely in either the shaft hole 124 or the spearhead hole 126 (e.g., clearance fit), but is held in place in the other (e.g., interference fit, weld, etc.). The cross-dimension (e.g., diameter) of the shaft 102 is configured to be robust enough to sufficiently withstand repeated door breaching puncture and removal forces. In the presented embodiment, outer dimensions (e.g., diameter when a circular cross-sectional profile) of the shaft 102 can be approximately double the pin cross-dimension (e.g., diameter when circular), or about 1.5 inches, or 0.5 inches to about 5 inches, from about 1 inch to about 4 inches, from about 1.25 to about 2 inches. The shaft outer dimension can be entirely encompassed or partially overlapped by a shaft cavity 116 in the spearhead 110 in the overlapping sections of the shaft 102 and spearhead 110. In the presented embodiment, the shaft cavity 116 is about 7.125 inches in length, but can be varied by design. Examples of the length of the shaft cavity 116 include from about 4 inches to about 20 inches, about 6 inches to about 15 inches, or about 8 inches to about 12 inches.

FIGS. 1A-1C show that the spearhead 110 includes at least one tapered region, which can be the illustrated first spearhead taper 130 that tapers into the tip 112 and a second spearhead taper 132 that tapers from the first spearhead taper 130 to a brace portion 134. However, it should be recognized that the spearhead 110 may include only a single tapered region or more than two tapered regions. The brace portion 134 includes the shaft cavity 116. The design includes a metal rod body that is tapered from one end (e.g., tip 112) and "channeled" on the other to form the shaft cavity 116. The taper includes a first spearhead taper 130 of a larger angle that is chosen to reduce susceptibility to bending/damage while still maintaining a sharp tip 112 for puncture. The second spearhead taper 132 is selected to provide a gradual increase in cross-dimension (e.g., diameter when circular) to allow for the spearhead 110 to penetrate a door with the force. The shaft cavity 116 is sufficiently wide and deep to entirely fit the cross-dimension (e.g., diameter when circular) of the shaft 102 with clearance inside it so that the spearhead 110 may: 1) puncture the door with no interference, and 2) rotate freely (e.g., about the pivot mechanism 108) once on the other side of the door. The angles of the tapered sections are chosen to ensure optimal puncture capability. Since the taper ends at a point 112, this means that the length of the tapered end of the spearhead 110 is affected by the cross-dimension (e.g., diameter when circular) of the brace portion 134, which is dependent on the thickness of the shaft 102, which is determined by the pin 128 size. The length of the shaft cavity 116 is then chosen to obtain a close to even distribution of length on either side of the pivot location (e.g., through-holes, 124, 126) so that there is minimal uneven pulling force on the door and tool. Another consideration for designing the length of the brace region and/or tapered section length is to ensure that the center of gravity of the spearhead 110 is on the tapered side (e.g., a tip-side 114 of the pivot mechanism 108) of the pivot point so that gravity will automatically deploy the spearhead 110 when the restraint 120 is moved off of the spearhead 110. In some aspects, the spearhead 110 includes a taper that ends in a point at the tip 112 or a sufficiently small area that can reasonably initiate puncture of common heavy duty door materials, such as steel at common heavy duty door thicknesses. Accordingly, the spearhead dimensions are set so that the center of gravity is on the pointed end side of the pivot point, such as on the tip-side 114 of the pivot mechanism 108.

In some embodiments, an end portion of the shaft cavity 116 is in the second spearhead taper 132 adjacent to the pivot mechanism 108. That is, the shaft cavity 116 may extend from the brace region 118 into the second spearhead taper 132.

Figure 4:
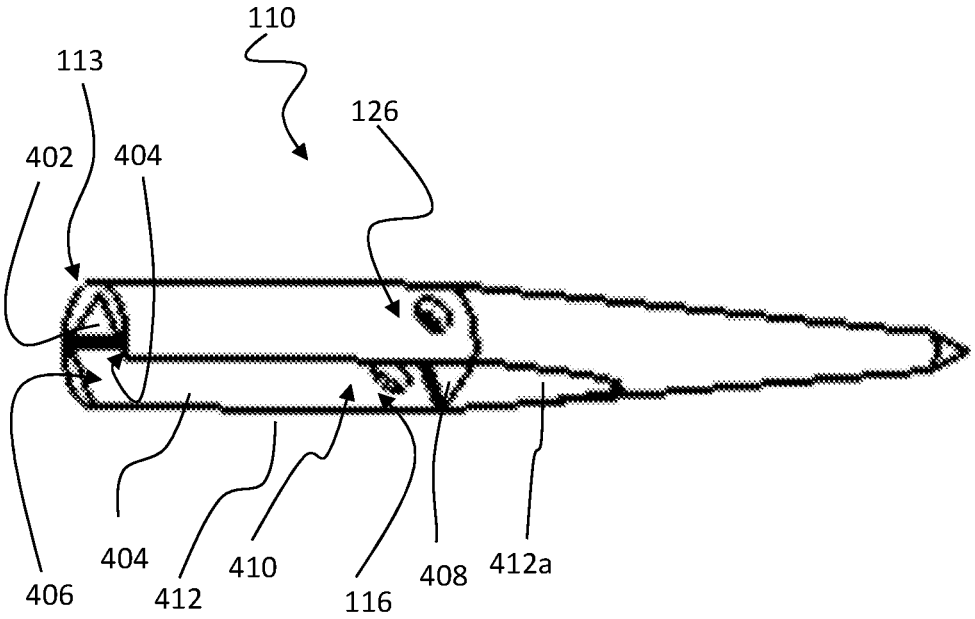
FIG. 4 illustrates a spearhead of the door breach device.

As shown in FIG. 1C and FIG. 4, the brace portion 134 around the shaft cavity 116 includes a "C" shaped cross-sectional profile. The shaft cavity 116 includes a cross-sectional profile that matches an outer surface of the shaft 102 such that the brace portion 134 can pivot on and off of the shaft 102 when the spearhead 110 pivots on the pivot mechanism 108. The shaft cavity 116 includes a base surface 402 with two side surfaces 404 extending therefrom. The shaft cavity 116 is elongate between a shaft cavity open end 406 and a shaft cavity end wall 408. The shaft cavity 116 includes a longitudinal slot shaped by the base surface 402, two side surfaces 404, and shaft cavity end wall 408. When in the puncture configuration, the first end 104 of the shaft 102 extends through the shaft cavity open end 406. The shaft cavity 116 includes a first cavity dimension between the two side surfaces 404 that is the same or greater than a corresponding cross-dimension (e.g., diameter) of the shaft 102.

The maximum vertical distance at any location on the entire spearhead 110 from the point furthest away from the closed base surface 402 of the shaft cavity 116 (e.g., vertically-speaking, with respect to gravity when the shaft is horizontal) on that side of the spearhead 110 is the distance that is achieved by making the shaft cavity 116 as wide as necessary to achieve a clearance fit encompassing the shaft 102. This means that there is a flat part (e.g., 412*a*) to the tapered side, which is used to provide more (and an even) surface area to pull on after deployment. The spearhead material is often steel, or can be ideally a hardened steel with corrosion resistant properties and reasonable tooling properties. However, other metals may be used, such as tungsten, or others.

The elongate slot of the shaft cavity 116 can include a longitudinal axis that is orthogonal with an axis of the pivot mechanism 108. The slot opening 410 of the shaft cavity 116 can be at a bottom of the spearhead 110, with respect to gravity when the longitudinal axis is horizontal. The base surface 402 of the shaft cavity 116 can be at a top of the spearhead 110, with respect to gravity when the longitudinal axis is horizontal. The spearhead 110 can include more mass on the tip-side 114 than on the shaft-side 118 relative to the pivot mechanism 108.

The shaft 102 is the masterpiece, connecting all parts into a functional tool. At the first end 104 (e.g., spearhead end) of the shaft 102, there is a vertically centered through hole 124 (e.g., with a horizontal axis) that the pin 128 fits through. The pin 128 can be configured to rotate freely in the hole 124 through means of a clearance fit. However, it should be recognized that the hole 124 and/or hole 126 can rotate around the pin 128 in different embodiments, where the rotation can be by hole 124 and/or hole 126 having a clearance fit. Also, one of hole 124 or hole 126 can have a friction fit or interference fit with the pin 128, such that one hole holds the pin 128 and the other hole rotates around the pin. In some embodiments, the pin 128 is fixed in the shaft 102 or the spearhead 110, and the other is allowed to rotate relative to the pin 128. In some embodiments, both the shaft 102 and spearhead 110 may rotate relative to the pin 128, such as when the pin 128 includes two retaining members outside of the shaft 102 and/or spearhead 110. A radius concentric to this hole 124 with a value of half the thickness of the shaft 102 is machined to the first end 104 of the shaft 102 to allow rotation of the spearhead 110. The edges of that radius at the first end 104 are filleted or rounded to further ensure rotational clearance. The cross-dimension (e.g., diameter when circular) of the shaft 102 is chosen to ensure the location on the shaft 102 with the thinnest material (e.g., the radius of the hole 124 mentioned previously) can withstand repeated door removal force. This is dependent on the pin radius chosen, which is similarly chosen on the ability to withstand the repeated pushing and pulling bending/shearing force of door breach operations. The length of the shaft 102 is chosen so that the center of gravity of the entire tool will be underneath the handle 150 to allow more convenient movement with the tool. The axial center of gravity of the door breach device 100 is located within the axial bounds of the handle 150. The shaft material can be steel, and is ideally a corrosion resistant steel with reasonable tooling properties.

In some embodiments, a door breach device 100 can include: an elongate shaft 102 having a first end 104 and an opposite second end 106; a pivot mechanism 108 at the first end 104; a spearhead 110 rotatably coupled with the pivot mechanism 108, the spearhead 110 having a tip 112 on a tip-side 114 of the pivot mechanism and having a shaft cavity 116 on a shaft-side 118, where the shaft cavity 116 is adapted to receive the shaft 102 therein; a restraint 120 configured to be slidably received on the shaft-side 118 of the spearhead 110 and on the shaft 102 when received into the shaft cavity 116; and a hitch 122 at the second end 106 of the shaft 102.

In some embodiments, a door breach device 100 can include: an elongate shaft 102 having a first end 104 and an opposite second end 106; a pivot mechanism 108 at the first end 104; a spearhead 110 rotatably coupled with the pivot mechanism 108, the spearhead 110 having a tip 112 on a tip-side 114 of the pivot mechanism and having a shaft cavity 116 on a shaft-side 118, where the shaft cavity 116 is adapted to receive the shaft 102 therein; a restraint 120 configured to be slidably received on the shaft-side 118 of the spearhead 110 and on the shaft 102 when received into the shaft cavity 116; a handle 150 protruding from the shaft 102; and a hitch 122 at the second end 106 of the shaft 102.

In some embodiments, a door breach device 100 can include: an elongate shaft 102 having a first end 104 and an opposite second end 106; a pivot mechanism 108 at the first end 104; a spearhead 110 rotatably coupled with the pivot mechanism 108, the spearhead 110 having a tip 112 on a tip-side 114 of the pivot mechanism and having a shaft cavity 116 on a shaft-side 118, where the shaft cavity 116 is adapted to receive the shaft 102 therein; a restraint 120 configured to be slidably received on the shaft-side 118 of the spearhead 110 and on the shaft 102 when received into the shaft cavity 116; and a hitch aperture 514 at the second end 106 of the shaft 102.

In some embodiments, a door breach device 100 can include: an elongate shaft 102 having a first end 104 with a tongue 278 or groove 276 and an opposite second end 106; a pivot mechanism 108 at the first end 104; a spearhead 110 rotatably coupled with the pivot mechanism 108 by having the other of the tongue 278 or groove 276 to form a rotatable tongue-in-groove coupling, the spearhead 110 having a tip 112 on a tip-side 114 of the pivot mechanism and having the tongue 278 or groove 276 on a shaft-side 118, where the groove 276 is adapted to receive the tongue 278 therein; a restraint 120 configured to be slidably received on the shaft-side 118 of the spearhead 110 and on the shaft 102 over an overlap region where the shaft 102 overlaps with the spearhead 110 in the tongue-in-groove coupling; and a hitch 122 at the second end 106 of the shaft 102.

In some embodiments, a door breach device 100 can include: an elongate shaft 102 having a first end 104 with a tongue 278 or groove 276 and an opposite second end 106; a pivot mechanism 108 at the first end 104; a spearhead 110 rotatably coupled with the pivot mechanism 108 by having the other of the tongue 278 or groove 276 to form a rotatable tongue-in-groove coupling, the spearhead 110 having a tip 112 on a tip-side 114 of the pivot mechanism and having the tongue 278 or groove 276 on a shaft-side 118, where the groove 276 is adapted to receive the tongue 278 therein; a restraint 120 configured to be slidably received on the shaft-side 118 of the spearhead 110 and on the shaft 102 over an overlap region where the shaft 102 overlaps with the spearhead 110 in the tongue-in-groove coupling; a handle 150 protruding from the shaft 102; and a hitch 122 at the second end 106 of the shaft 102.

In some embodiments, a door breach device 100 can include: an elongate shaft 102 having a first end 104 with a tongue 278 or groove 276 and an opposite second end 106; a pivot mechanism 108 at the first end 104; a spearhead 110 rotatably coupled with the pivot mechanism 108 by having the other of the tongue 278 or groove 276 to form a rotatable tongue-in-groove coupling, the spearhead 110 having a tip 112 on a tip-side 114 of the pivot mechanism and having the tongue 278 or groove 276 on a shaft-side 118, where the groove 276 is adapted to receive the tongue 278 therein; a restraint 120 configured to be slidably received on the shaft-side 118 of the spearhead 110 and on the shaft 102 over an overlap region where the shaft 102 overlaps with the spearhead 110 in the tongue-in-groove coupling; and a hitch aperture 514 at the second end 106 of the shaft 102.

In some embodiments, a door breach device 100 can include: an elongate shaft 102 having a first end 104 with a shaft arm 282 and an opposite second end 106; a pivot mechanism 108 at the first end 104; a spearhead 110 rotatably coupled with the pivot mechanism 108 by having the spearhead arm 284 to form a rotational coupling with the shaft arm 282, the spearhead 110 having a tip 112 on a tip-side 114 of the pivot mechanism; a restraint 120 configured to be slidably received on the shaft-side 118 of the spearhead 110 and on the shaft 102 over an overlap region where the shaft 102 overlaps with the spearhead 110 in the rotational coupling formed from the shaft arm 282 and the spearhead arm 284; and a hitch 122 at the second end 106 of the shaft 102.

In some embodiments, a door breach device 100 can include: an elongate shaft 102 having a first end 104 with a shaft arm 282 and an opposite second end 106; a pivot mechanism 108 at the first end 104; a spearhead 110 rotatably coupled with the pivot mechanism 108 by having the spearhead arm 284 to form a rotational coupling with the shaft arm 282, the spearhead 110 having a tip 112 on a tip-side 114 of the pivot mechanism; a restraint 120 configured to be slidably received on the shaft-side 118 of the spearhead 110 and on the shaft 102 over an overlap region where the shaft 102 overlaps with the spearhead 110 in the rotational coupling formed from the shaft arm 282 and the spearhead arm 284; a handle 150 protruding from the shaft 102; and a hitch 122 at the second end 106 of the shaft 102.

In some embodiments, a door breach device 100 can include: an elongate shaft 102 having a first end 104 with a shaft arm 282 and an opposite second end 106; a pivot mechanism 108 at the first end 104; a spearhead 110 rotatably coupled with the pivot mechanism 108 by having the spearhead arm 284 to form a rotational coupling with the shaft arm 282, the spearhead 110 having a tip 112 on a tip-side 114 of the pivot mechanism; a restraint 120 configured to be slidably received on the shaft-side 118 of the spearhead 110 and on the shaft 102 over an overlap region where the shaft 102 overlaps with the spearhead 110 in the rotational coupling formed from the shaft arm 282 and the spearhead arm 284; and a hitch aperture 514 at the second end 106 of the shaft 102.

In some embodiments, a door breach device 100 can include: an elongate shaft 102 having a first end 104 and an opposite second end 106; a pivot mechanism 108 at the first end 104; a spearhead 110 rotatably coupled with the pivot mechanism 108 by having the spearhead form a rotational coupling with the first end 104 of the elongate shaft, the spearhead 110 having a tip 112 on a tip-side 114 of the pivot mechanism 108; a restraint 120 configured to be slidably received on a shaft-side 118 of the spearhead 110 and on the shaft 102 to stop rotation of the spearhead 110 relative to the elongate shaft 102; and a hitch aperture 514 at the second end 106 of the shaft 102.

In some embodiments, the first end 104 of the shaft 102 includes a shaft pin aperture 124; the spearhead 110 includes at least one spearhead pin aperture 126; and a pin 128 is located in the shaft pin aperture 124 and the at least one spearhead pin aperture 126 so as to form the pivot mechanism 108. In some aspects, the spearhead 110 includes: a first spearhead taper 130 that tapers into the tip 112; a second spearhead taper 132 that tapers from the first spearhead taper 130 to a brace portion 134, wherein the brace portion 134 includes the shaft cavity 116. In some aspects, an end portion of the shaft cavity 116 is in the second spearhead taper 132 adjacent to the pivot mechanism 108. In some aspects, the brace portion 134 around the shaft cavity 116 includes a "C" shaped cross-sectional profile. In some aspects, the shaft cavity 116 includes a cross-sectional profile that matches an outer surface of the shaft 102 such that the brace portion 134 can pivot on and off of the shaft 102 when the spearhead 110 pivots on the pivot mechanism 108. In some aspects, the shaft cavity 116 includes a base surface 402 with two side surfaces 404 extending therefrom. In some aspects, the shaft cavity 116 is elongate between a shaft cavity open end 406 and a shaft cavity end wall 408. In some aspects, the shaft cavity 116 includes a longitudinal slot shaped by the base surface 402, two side surfaces 404, and shaft cavity end wall 408. In some aspects, the first end 104 of the shaft 102 extends through the shaft cavity open end 406. In some aspects, the shaft cavity 116 includes a first cavity dimension between the two side surfaces 404 that is the same or greater than a corresponding cross-dimension (e.g., diameter) of the shaft 102. In some aspects, the elongate slot of the shaft cavity 116 includes a longitudinal axis that is orthogonal with an axis of the pivot mechanism 108. In some aspects, the slot opening 410 of the shaft cavity 116 is a bottom of the spearhead 110, with respect to gravity. In some aspects, the base surface 402 of the shaft cavity 116 is at a top of the spearhead 110, with respect to gravity. In some aspects, the spearhead 110 includes more mass on the tip-side 114 than on the shaft-side 118 relative to the pivot mechanism 108.

In some embodiments, the restraint 120, when coupled to the spearhead 110 prevents the spearhead 110 from pivoting at the pivot mechanism 108. In some aspects, the restraint 120 includes a restraint aperture 302, wherein the spearhead 110 and/or shaft 102 is received through the restraint aperture 302. In some aspects, the restraint aperture 302 includes at least one aperture spearhead surface 304 slidably contacting the spearhead 110. In some aspects, the restraint aperture 302 includes at least one aperture shaft surface 306 slidably contacting the shaft 102. In some embodiments, the at least one aperture shaft surface 306 is located on an aperture protrusion 308. In some embodiments, the aperture protrusion 308 extends inwardly to a center point of the restraint aperture 302 from the at least one aperture shaft surface 306. In some embodiments, the at least one aperture shaft surface 306 is dimensioned to be less than or equal to the first cavity dimension between the two side surfaces 404. In some aspects, a body 308 of the restraint 120 includes at least one push surface 310 that is at an angle relative to a longitudinal axis of the shaft 102. In some aspects, the at least one push surface 310 is configured to be pushed so as to push the restraint 120 from the spearhead 110 to the shaft 102. In some aspects, the angle is orthogonal. In some aspects, the angle is orthogonal with the longitudinal axis of the shaft 112 and of an axis of the pin 128. In some aspects, the restraint 120 includes a plate body 308 having the restraint aperture 302. In some aspects, the restraint 120 includes a cross-sectional profile that is a circle, triangle, square, rectangle, or other polygon.

In some embodiments, the hitch 122 includes a mounting member 502 that is adapted to be mounted to the second end 106 of the shaft 102. In some aspects, the mounting member 502 extends from the second end 106 of the shaft 102 toward the first end 104 of the shaft 102. In some aspects, the mounting member 502 includes at least one mounting aperture 504 that is aligned with at least one end aperture 506 at the second end 106 with at least one mounting fastener 508 extending through the at least one mounting aperture 504 and the at least one end aperture 506. In some aspects, the mounting member includes at least one mounting plate 510. In some aspects, the hitch 122 includes at least one hitch member 512. In some aspects, the at least one hitch member 512 is configured to be hitched to an object. In some aspects, the object is a vehicle or mechanical device. In some embodiments, the at least one hitch member 512 includes a hitch aperture 514. In some aspects, the at least one hitch member 512 includes a ram surface 516. In some aspects, the at least one mounting fastener 508 includes a bolt that is fastened to a nut 518.

In some embodiments, the door breach device includes at least one handle 150 mounted to the shaft 102. In some aspects, the handle 150 is protruding from the shaft 102. In some aspects, at least one handle 150 is mounted on a top half or top hemisphere of the shaft 102. In some aspects, at least one handle 150 is aligned with a rotational plane of the spearhead 110. In some aspects, at least one handle 150 is an elongate member and has two ends mounted spaced apart on the shaft 102. In some embodiments, at least two handles 150 are mounted on a top half or top hemisphere of the shaft 102.

In some embodiments, a hitch aperture 514 includes an axis that is parallel with an axis of the pivot mechanism 108 (e.g., parallel with the apertures 124, 126 and pin 128. In some aspects, a rotational plane of the spearhead 110 is orthogonal with the axes of the pivot mechanism 108 and the hitch aperture 514. In some aspects, a hitch aperture 514 includes an axis that is not parallel with an axis of the pivot mechanism 108 (e.g., parallel with the apertures 124, 126 and pin 128. In some aspects, a rotational plane of the spearhead 110 is not orthogonal with the axes of the pivot mechanism 108 and the hitch aperture 514.

In some embodiments, the spearhead 110 and restraint 120 include two operational configurations comprising: a puncture configuration where the restraint 120 retains the spearhead 110 aligned with the shaft 102; or a breach configuration where the restraint 120 is disengaged from the spearhead 110. In some aspects, the puncture configuration includes the shaft 102 having a longitudinal axis that is parallel of a longitudinal axis of the spearhead 110. In some aspects, the puncture configuration includes a longitudinal axis of the spearhead 110 being perpendicular with a ram surface 516 of the hitch 122. In some aspects, a region of the spearhead 110 surrounding the shaft 102 is restrained by the restraint 120. In some aspects, the restraint 120 includes a restraint aperture 302 that at least partially or fully encircles a region of the spearhead 110 surrounding the shaft 102. In some aspects, the puncture configuration the spearhead 110 is fixed and not rotatable relative to the shaft 102 by the restraint 120. Once the restraint 120 is pushed past the spearhead 110 (e.g., no longer around or restraining the spearhead 110 to the shaft 102, the spearhead 110 freely rotates to the breach configuration. In some aspects, a greater mass of the tip-side 114 of the spearhead 110 than a smaller mass of the shaft-side 118 of the spearhead 100 allows gravity to cause rotation of the spearhead 110 from the puncture configuration to the breach configuration. In some aspects, when in the puncture configuration, a longitudinal axis of the spearhead 110 is aligned with a longitudinal axis of the shaft 102; or when in the breach configuration, a longitudinal axis of the spearhead 110 is at an angle with respect to a longitudinal axis of the shaft 102. In some aspects, its angle is between about 75 degrees and about 105 degrees, or about 80 degrees and about 100 degrees, or about 85 degrees and about 95 degrees, or about 90 degrees. In some aspects, in the breach configuration, a bottom surface 412, 412*a* of the spearhead 110 is at the angle. In some aspects, the bottom surface 412 is an edge of the slot opening 410. In some aspects, the bottom surface 412*a* is a planar region formed into a bottom side (e.g., with respect to gravity) of the second taper region 132. In some aspects, the bottom surface 412 on the brace region 134 is planar and continuous with the bottom surface 412*a* on the second taper region 132. In some aspects, in the breach configuration, the shaft 102 and spearhead 110 form a "T" shape.

In some embodiments, a spearhead pin aperture 126 is vertically offset (e.g., with respect to gravity) with respect to a central longitudinal axis or a horizontal equatorial plane of the spearhead 110 and/or brace region 134. In some aspects, the spearhead pin aperture 126 is in a middle region or about equidistant from an apex of the spearhead 110 and/or brace region 134 to a bottom surface 412 of the spearhead 110 and/or brace region 134. In some aspects, the spearhead pin aperture 126 is further from an apex of the spearhead 110 and/or brace region 134 and closer to a bottom surface 412 of the spearhead 110 and/or brace region 134. In some aspects, the spearhead pin aperture 126 is closer to an apex of the spearhead 110 and/or brace region 134 and further from a bottom surface 412 of the spearhead 110 and/or brace region 134.

In some embodiments, at least one handle 150 protrudes from an outer surface of the shaft 102, wherein the protruding distance of the handle 150 creates a dimension from a top of the handle 105 to a bottom of the shaft 102 (e.g., vertically or with respect to gravity) such that the dimension is greater than a largens cross-sectional dimension of the restraint aperture 302. In some aspects, the restraint 120 cannot slide onto or past the at least one handle 150. In some aspects, at least one handle 150 functions as a block to block sliding of the restraint 120 toward the second end 106 of the shaft 102.

In some embodiments, the door breach device includes a tow member 700*a*, 700*b*, 700*c* coupled to the hitch 122, which may be removably coupled to the hitch and being capable of being removably coupled to a force actuator.

In some embodiments, a kit can include: the door breach device of one of the embodiments; and a tow member 700*a*, 700*b*, 700*c*. In some aspects, the kit can include a post rammer 900 received onto the hitch 122.

In some embodiments, a kit can include: the door breach device of one of the embodiments; and a post rammer 800 having an open end 802 and internal chamber 804 adapted to be fit over the hitch 122.

Figure 2A:
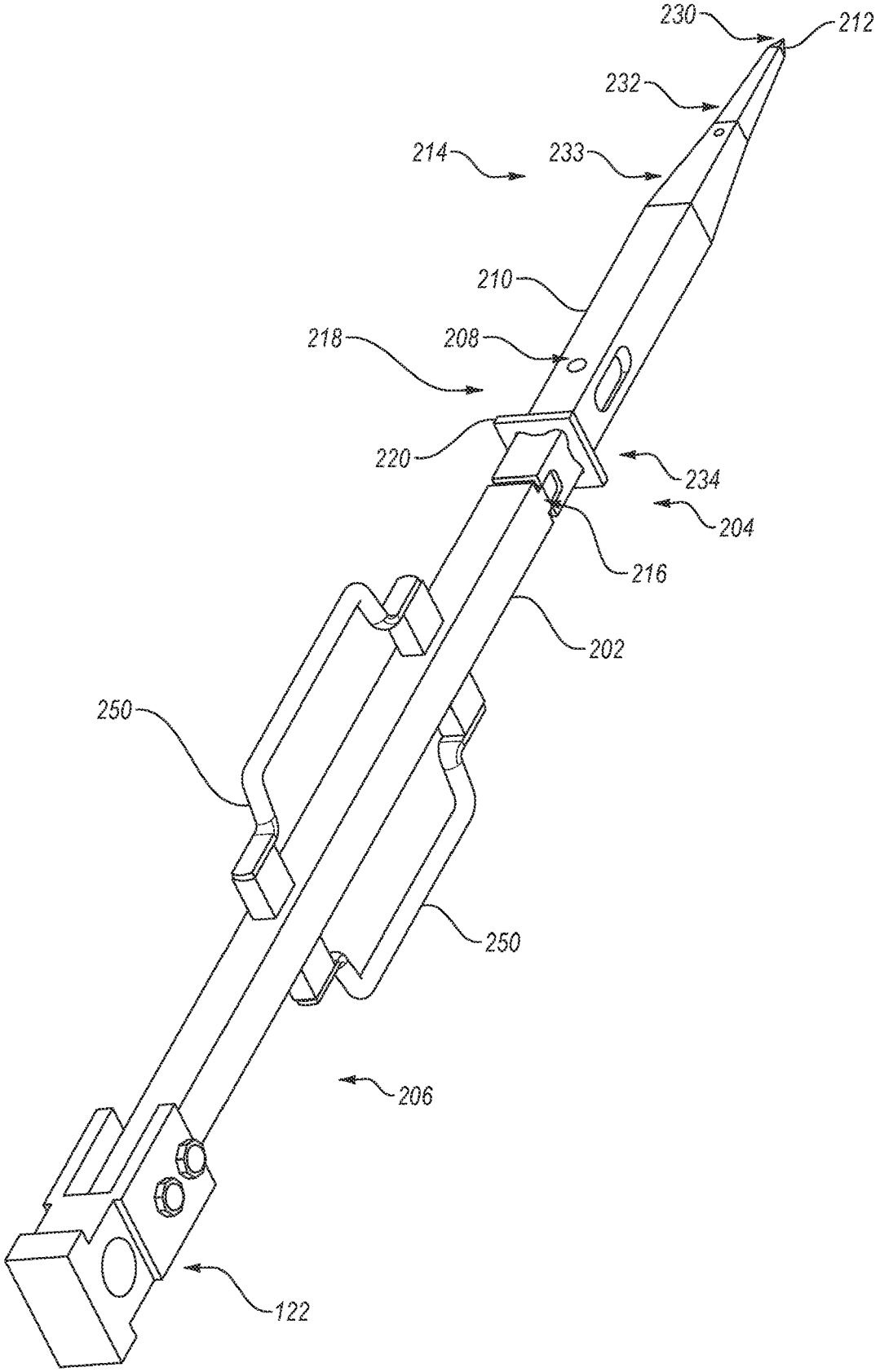
FIGS. 2A-2B illustrate another embodiment of a door breach device in different stages of use.
Figure 2B:
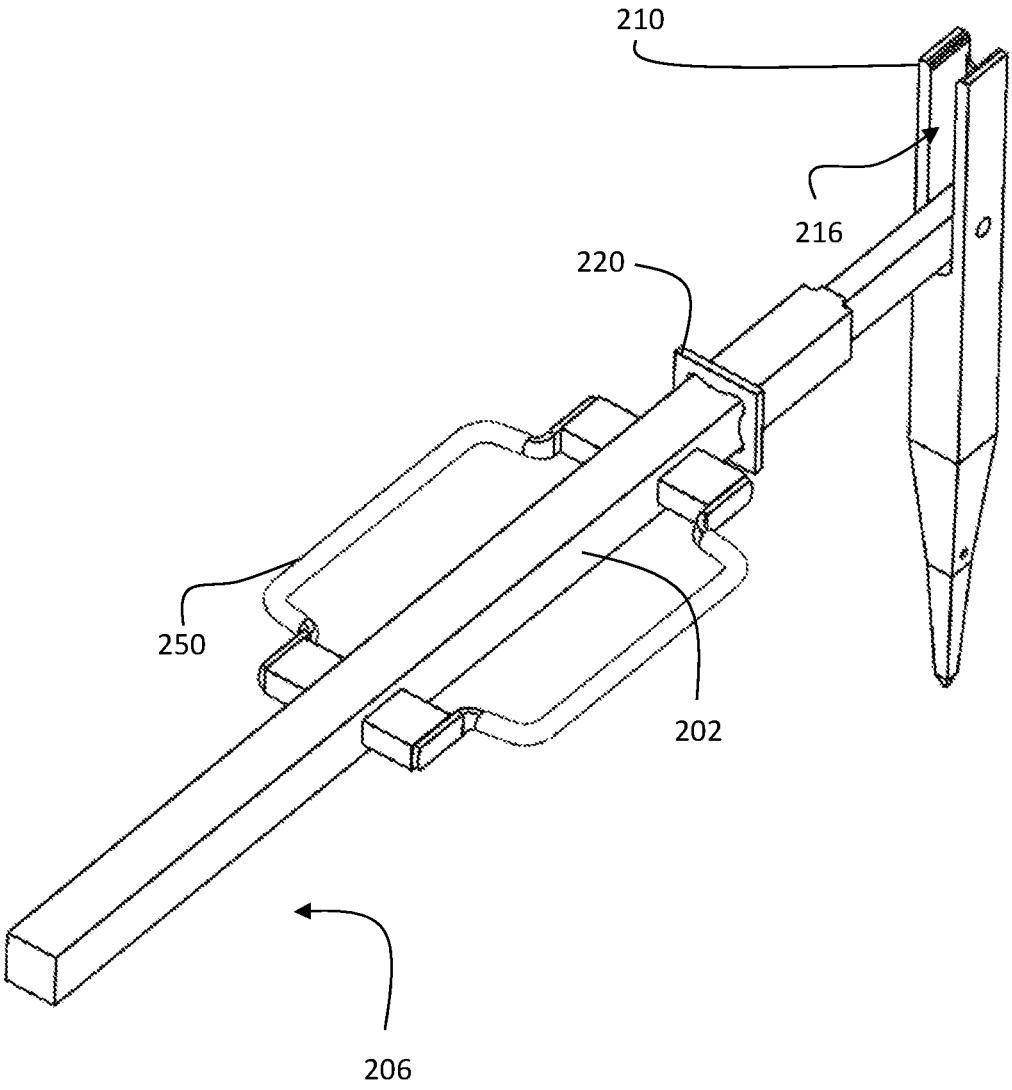
Figure 2C:
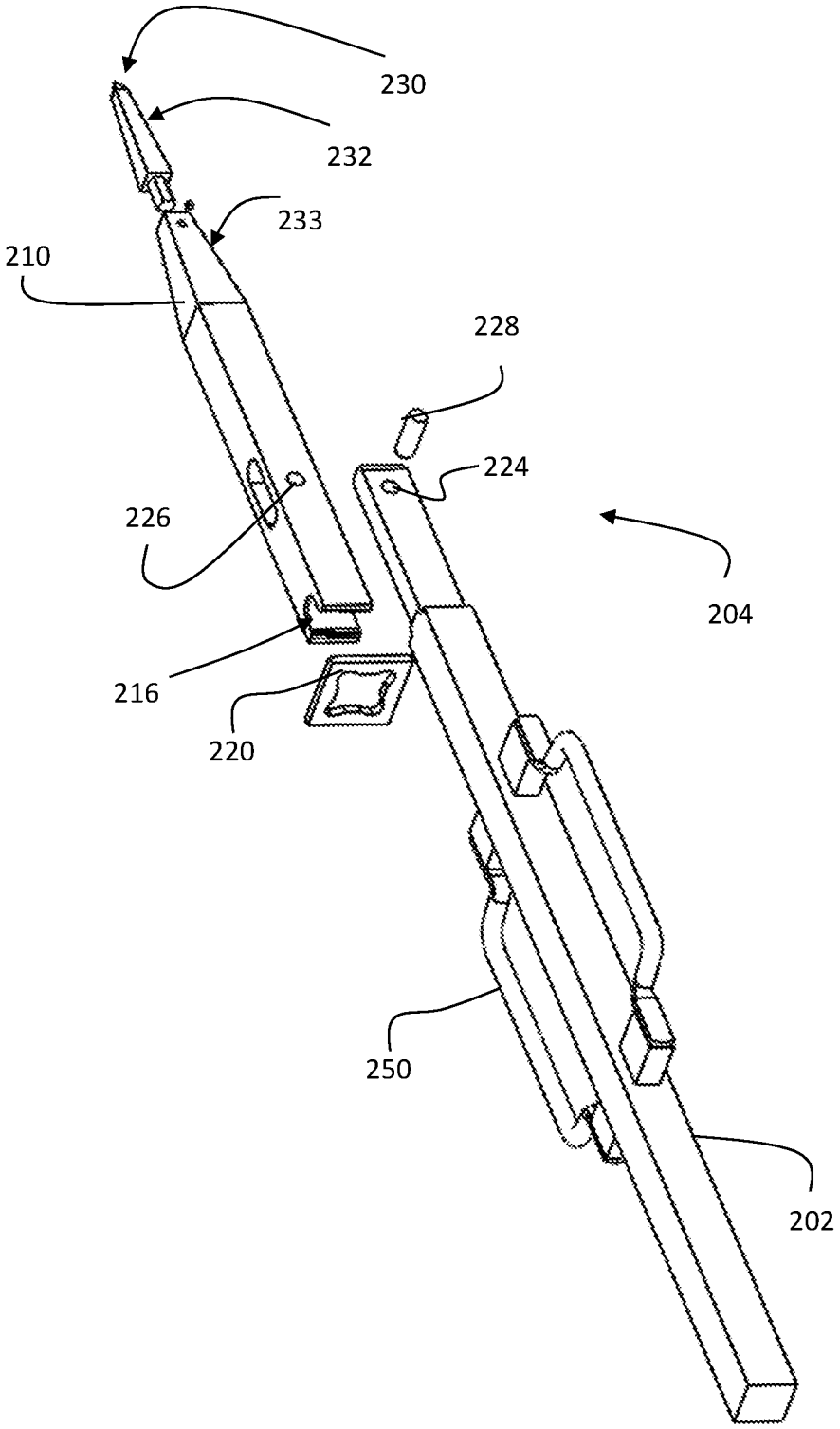
FIG. 2C illustrates an exploded view of the door breach device of FIGS. 2A-2B.
Figure 2D:
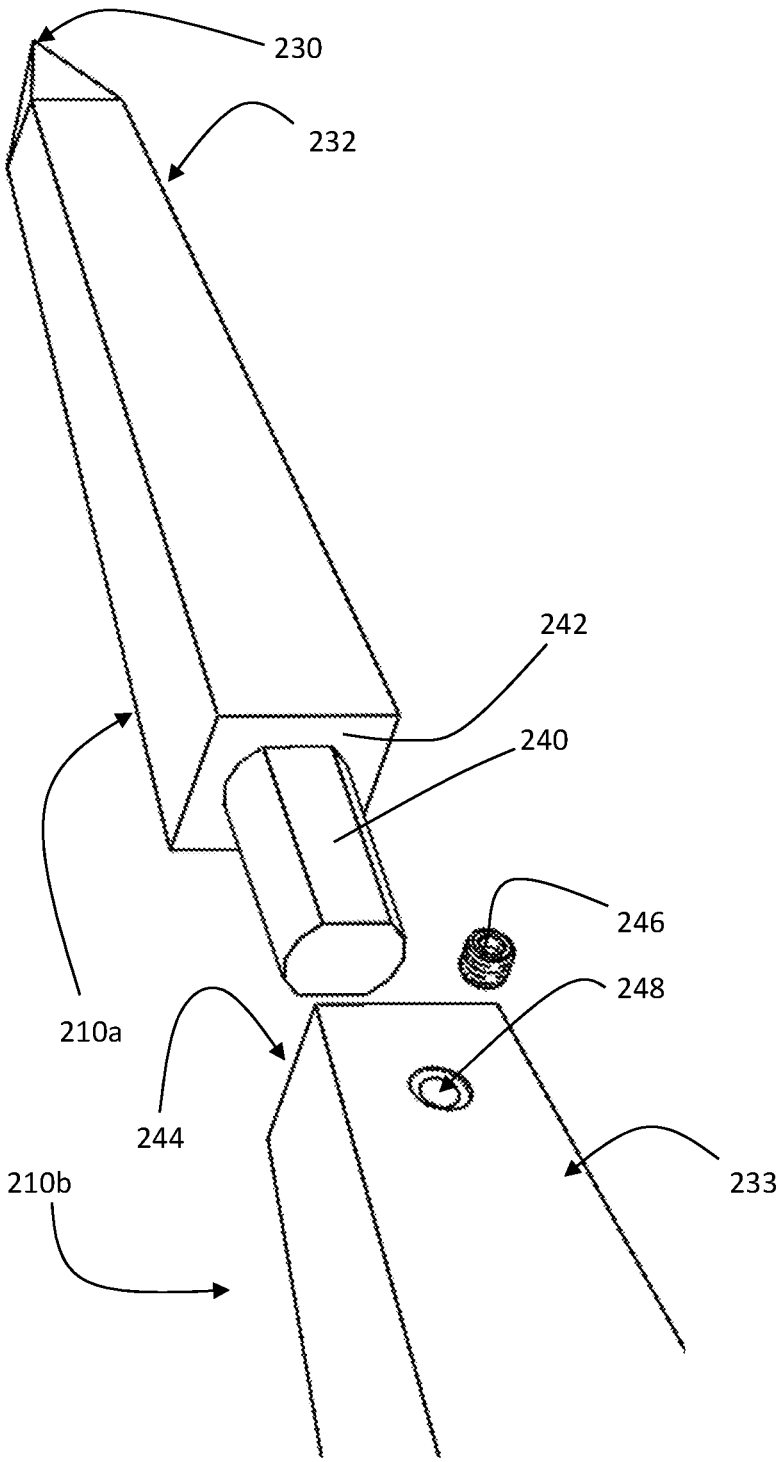
FIG. 2D illustrates a magnified view of the end of the exploded view of the door breach device of FIG. 2C.

FIGS. 2A-2D illustrate a polygon shaped (e.g., square, rectangle, but could be other shape) door breach device 200 in a puncture configuration (FIG. 2A), a transitional configuration with restraint 220 removed from spearhead 210 is not shown but can be exemplified by FIG. 1B, and in a breach configuration (e.g., FIG. 2B). FIG. 2C shows an exploded view of the door breach device 200, and FIG. 2D shows a magnification of the first end 204 showing the replaceable tip 212. The door breach device 200 can also include a hitch 122 at the second end 206 of the shaft 202.

The door breach device 200 is shown to include an elongate shaft 202 with a polygon cross-sectional profile and having a first end 204 and an opposite second end 206. A pivot mechanism 208 is located at the first end 204. A spearhead 210 is rotatably coupled with the pivot mechanism 208. The spearhead 1210 has a removable tip 212 on a tip-side 214 of the pivot mechanism 208 and has a shaft slot 216 on a shaft-side 218 of the pivot mechanism 208. The shaft slot 216 is adapted to receive the shaft 202 by rotation therein, such that the shaft 202 and spearhead 210 can rotate relative to each other. The door breach device 200 includes a restraint 220 that is configured to be slidably received on the shaft-side 218 of the spearhead 210 and slidably received on the shaft 202 when the shaft 202 is received into the shaft slot 216 or slidable on the shaft 202 after the spearhead 210 has rotated off of the shaft 202 (e.g., shaft 102 no longer in the shaft slot 216). The door breach device 200 can also include a hitch 122 at the second end 206 of the shaft 202.

The illustrated door breach device 200 can also be configured to include: an elongate shaft 202 having a first end 204 and an opposite second end 206; a pivot mechanism 208 at the first end 204; a spearhead 210 rotatably coupled with the pivot mechanism 208, the spearhead 210 having a removable tip 212 on a tip-side 214 of the pivot mechanism and having a shaft slot 216 on a shaft-side 218, where the shaft slot 216 is adapted to receive the shaft 202 therein by relative rotation in either direction (e.g., two different and opposite sides can be the top side to allow gravity rotation of the spearhead 210); a restraint 220 configured to be slidably received on the shaft-side 218 of the spearhead 210 and on the shaft 202 when received into the shaft slot 216; a pair of handles 250 are protruding from the shaft 102; and a hitch at the second end 206 of the shaft 202.

The door breaching device 200 is also a tool configured to be capable of puncturing a door, deploying the spearhead 210 into a brace "T" shape", and remove outward opening and heavy duty doors. The shaft 202 is the connecting part for all other parts of the tool. The spearhead 210 is the puncturing and deploying part (e.g., deploy into a brace) of the tool. The pin 228 that is the pivot point (e.g., pivot mechanism 208) of the spearhead 210 also functions for connecting the spearhead 210 to the shaft 202. The restraint 220 is shaped to hold the spearhead 210 parallel to the shaft 202 in the puncture configuration until in use and a door pushes against the restraint 220 so that a restraint 220 slides along the shaft 202 toward the second end 206, such as toward the handle 250 or hitch, thereby allowing the spearhead 210 to rotate and deploy into the brace "T" shape. The hitch 122 shown in FIG. 1A can be applied to the shaft 206 of the door breach device 200 so as to provide the portion of the device that allows for receiving the puncture force (e.g., when applied by a device, the handle 250 is used to apply puncture force by a human) and removal force, by providing an application point and is attached to the second end 206 of the shaft 202 at the opposite end from the spearhead 210. One or more handles 250 are attached to the shaft 202, about near the center of gravity. The one or more handles 250 are used to safely hold the door breach device 200 in place during the puncturing procedure. The one or more handles 250 can also be used to protect the users' hands from being smashed during puncturing of the door during the door breach protocol. The one or more handles 250 can also function to stop the door breach device 200 from penetrating an unnecessary amount through the door. The one or more handles 250 can also function to allow a human user to swing the door breach device 200 into a door, such that the spearhead 210 can puncture some types of doors without additional force being applied to the hitch 222.

As shown in FIG. 2C, the first end 204 of the shaft 202 includes a shaft pin aperture 224. Correspondingly, the spearhead 210 includes at least one spearhead pin aperture 226. A pin 228 is located in the shaft pin aperture 224 and the at least one spearhead pin aperture 226 so as to form the pivot mechanism 208. This allows for the spearhead 210 to rotate relative to the shaft 202 unless retained in the puncture configuration by the restraint 220. Accordingly, the spearhead 210 is connected to the shaft 202 with the pin 228 that fits into holes 224, 226 that run entirely through the untapered section (e.g., brace portion 234) of the spearhead 210 and the first end 204 of the shaft 202. The first end 204 of the shaft 202 is covered or overlapped by the brace portion 234 of the spearhead 210 when in the puncture configuration. The second end 204 of the shaft 202 is removed from the spearhead 210 once it rotates to the breach configuration (e.g., shaped as a brace). While the device is illustrated and described to be square or rectangular (e.g., cuboid), which includes a cuboid cross-sectional profile, it should be recognized that the different features and elements may have cross-sectional profiles that are triangular or other polygon cross-sectional profile shape. As such, the spearhead 200 and shaft 202 may have any suitable cross-sectional profile shape. Particularly, the shaft 202 and brace portion 234 may have a cross-sectional profile that is a polygon shape.

FIGS. 2A-2D show that the spearhead 210 includes at least one tapered region, which can be the illustrated first spearhead taper 230 that tapers into the tip 212 and a second spearhead taper 232 that tapers from the first spearhead taper 230 to third spearhead taper 233 that tapers to the brace portion 234 (e.g., not tapered). However, it should be recognized that the spearhead 210 may include only a single tapered region or more than three tapered regions. The brace portion 234 includes the shaft slot 216. The design includes a metal rod body that is tapered from one end (e.g., tip 212) and "channeled" on the other to form the shaft slot 216. The taper includes a first spearhead taper 230 of a larger angle that is chosen to reduce susceptibility to bending/damage while still maintaining a sharp tip 212 for puncture. The second spearhead taper 232 and third taper 233 are both selected to provide a gradual increase in cross-dimension (e.g., width when polygon) to allow for the spearhead 210 to penetrate a door with the force. The shaft slot 216 is sufficiently wide and deep to entirely fit the cross-dimension (e.g., width when polygon) of the shaft 202 with clearance inside it so that the spearhead 210 may: 1) puncture the door with no interference, and 2) rotate freely (e.g., about the pivot mechanism 208) once on the other side of the door. The angles of the tapered sections are chosen to ensure optimal puncture capability. Since the taper ends at a point 212, this means that the length of the tapered end of the spearhead 210 is affected by the cross-dimension (e.g., width when polygon) of the brace portion 1234, which is dependent on the thickness of the shaft 202, which is determined by the pin 228 size. The length of the shaft slot 216 is then chosen to obtain a close to even distribution of length on either side of the pivot location (e.g., through-holes, 224, 226) so that there is minimal uneven pulling force on the door and tool. Another consideration for designing the length of the brace region and/or tapered section length is to ensure that the center of gravity of the spearhead 210 is on the tapered side (e.g., a tip-side 214 of the pivot mechanism 208) of the pivot point so that gravity will automatically deploy the spearhead 210 when the restraint 220 is moved off of the spearhead 210. In some aspects, the spearhead 210 includes a taper that ends in a point at the tip 212 or a sufficiently small area that can reasonably initiate puncture of common heavy duty door materials, such as steel at common heavy duty door thicknesses. Accordingly, the spearhead dimensions are set so that the center of gravity is on the pointed end side of the pivot point, such as on the tip-side 214 of the pivot mechanism 208.

FIG. 2D shows a magnified portion of the replaceable spearhead 210, shown as a removable portion 210*a* and a receiver portion 210*b*, where the removable portion 210*a* is received into the receiver portion 210*b*. The removable portion 210*a* is shown to have an insert member 240 extending from its base 242. The receiver portion 210*b* includes a receiver slot 244 for receiving the insert member 240. The receiver portion 210*b* includes a fastener mechanism shown as a threaded screw 246 that screws into a threaded aperture 248; however, other means of fixation of the removable portion 210*a* to the receiver portion 210*b* can be used. Here, the threaded screw 246 is screwed into the threaded aperture 248 until engaging with the insert member 240. However, the insert member 240 may be on the receiver portion 210*b* and the receiver slot 244 may be on the removable portion 210*a*.

In view of the foregoing, it should be recognized that the components of one embodiment of the device can be applied to other embodiments of the device.

Figure 3:
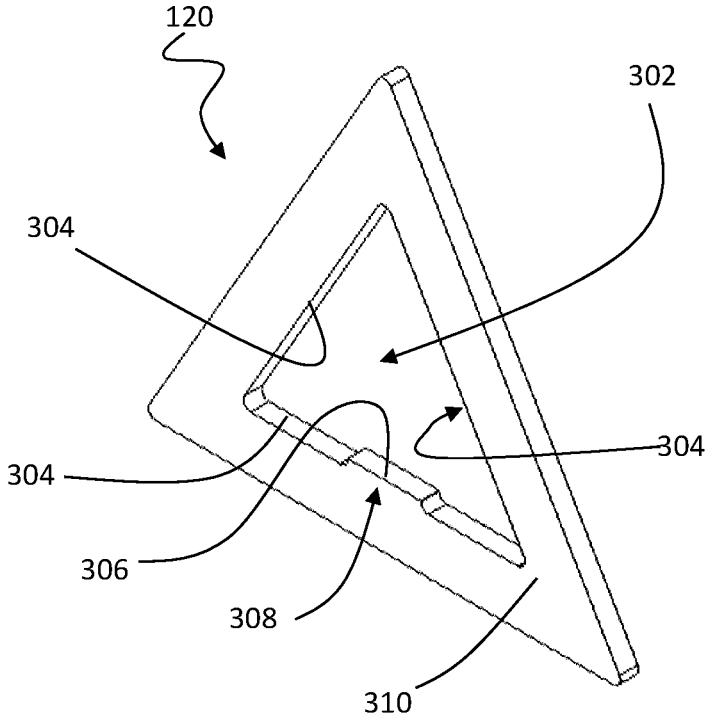
FIG. 3 illustrates an embodiment of a restraint of the door breach device.
Figure 9:
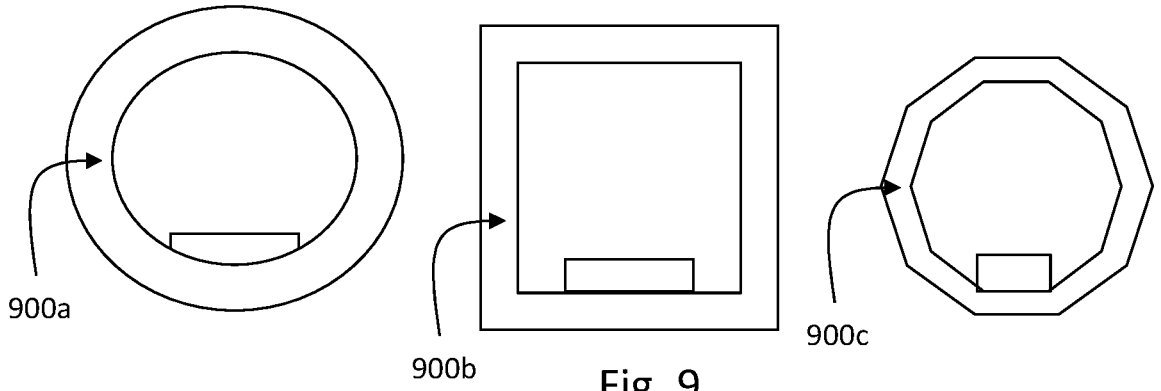
FIG. 9 illustrates different embodiments of restraints of the door breach device.

In some embodiments of the door breach device 100, the restraint 120, when coupled to the spearhead 110 prevents the spearhead 110 from pivoting at the pivot mechanism 108. FIG. 3 shows an embodiment of a triangular restraint 120; however, other shapes and configurations can be used. The restraint 120 can include a restraint aperture 302, wherein the spearhead 110 and/or shaft 102 is received through the restraint aperture 302. The restraint aperture 302 can include at least one aperture spearhead surface 304 slidably contacting the spearhead 110. The restraint aperture 302 can include at least one aperture shaft surface 306 slidably contacting the shaft 102. The at least one aperture shaft surface 306 can be located on an aperture protrusion 308. The aperture protrusion 308 can extend inwardly to a center point of the restraint aperture 302 from the at least one aperture shaft surface 306, such as towards the center of the spearhead 110 and/or center of the shaft 102 when thereon. The at least one aperture shaft surface 306 can be dimensioned to be less than or equal to the first cavity dimension between the two side surfaces 404. In some aspects, a body 308 of the restraint 120 can include at least one push surface 310 that is at an angle relative to a longitudinal axis of the shaft 102. The at least one push surface 310 can be configured to be pushed so as to push the restraint 120 from the spearhead 110 to the shaft 102. In some aspects, the angle relative to a longitudinal axis of the shaft 102 is orthogonal. In some aspects, the angle is orthogonal with the longitudinal axis of the shaft 112 and of an axis of the pin 128. The restraint 120 can include a plate body 308 having the restraint aperture 302. The restraint 120 can include a cross-sectional profile that is a circle 900*a* (FIG. 9), triangle, square 900*b* (FIG. 9), rectangle, or other polygon 900*c* (FIG. 9).

In some embodiments, the aperture protrusion 308 can be omitted. In these embodiments, some other feature, such as the at least one aperture spearhead surface 304 may provide the function to provide resistance to sliding of the restraint 120 relative to the shaft 102 and/or spearhead 110.

For example, the restraint 120 can be a triangle or any other suitable shape with an aperture in it that encompasses/surrounds both the spearhead 110 and the shaft 120 when in the puncture configuration. The restraint 120 slides on and off of the spearhead 120 throughout usage cycles, but always remains around the shaft 102. In some embodiments, the restraint 120 can be slidable relative to the shaft 102 and spearhead 110, and can slide on or off at any time, such as after assembly, prior to use, or after use. The restraint 120 can then be slid onto the shaft 102 as needed.

The restraint 120 can have any suitable shape and dimensions. The restraint 110 holds the spearhead 110 parallel to the shaft 102 in its undeployed state (e.g., puncture configuration). The restraint 120 is axially located somewhere over the shaft cavity 116 of the spearhead 110 until deployment, when it is on the shaft 102 somewhere between the handle 150 and the door. The restraint 120 can include a tight clearance fit in contact with the spearhead 110 and shaft 102 to: 1) minimize movement of the spearhead 110 during penetration of a door; and 2) allow the restraint 120 to be pushed longitudinally (e.g., axially) toward the handle 150 and ultimately off the spearhead 110, allowing deployment of the spearhead 110 to the "T" brace shape with the shaft 102. Since the restraint 120 does not carry a heavy structural load, the restraint 120 can be thin (e.g., with respect to the longitudinal axis of the shaft 102). The thickness of the body parts, such as the arms or sides of the triangle shape, in the non-longitudinal axial direction (e.g., in a radial direction) are wide enough to ensure that the restraint 120 can: 1) cleanly catch the door as the spearhead 110 is penetrating the door; and 2) retain structural integrity (e.g., not break) by holding the spearhead 110 in the puncture configuration (e.g., position aligned with the shaft 102). An exemplary characteristic of the restraint 102 is the straight bottom edge (e.g., bottom aperture spearhead surface 304) with a raised section or protrusion 308. The raised section 308 is designed to close the gap between the recessed shaft 102 in the spearhead 110 shaft cavity 116 and the restraint 120, which spans the spearhead shaft cavity 116 gap. That is, the surface 306 on the protrusion 308 can span from the side wall 404 to opposite side wall 404. The restraint material can be steel, or ideally any corrosion resistant with excellent tooling properties.

Figure 5A:
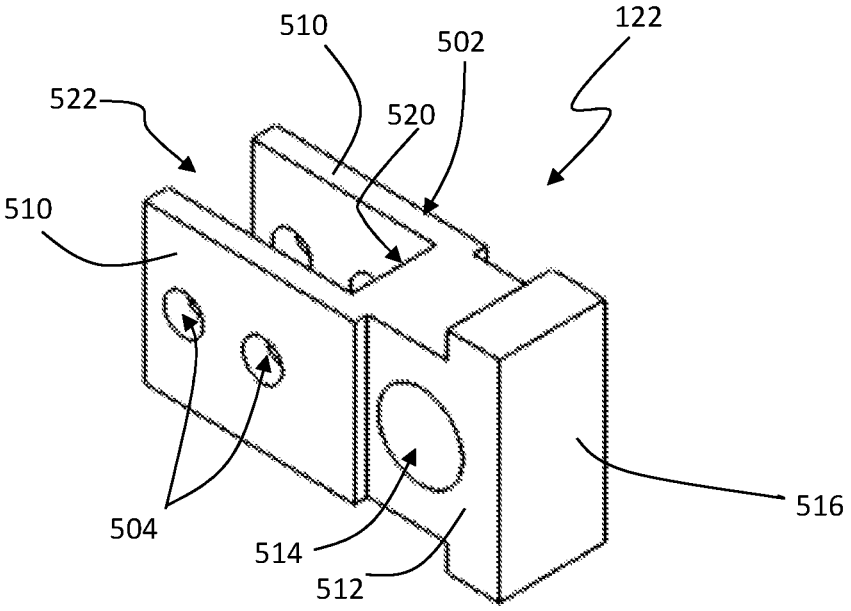
FIGS. 5A-5C illustrate different embodiments of a hitch of the door breach device.
Figure 5B:
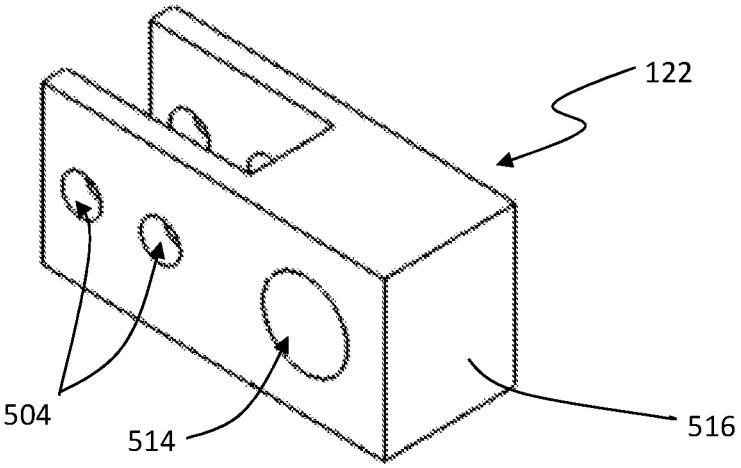
Figure 5C:
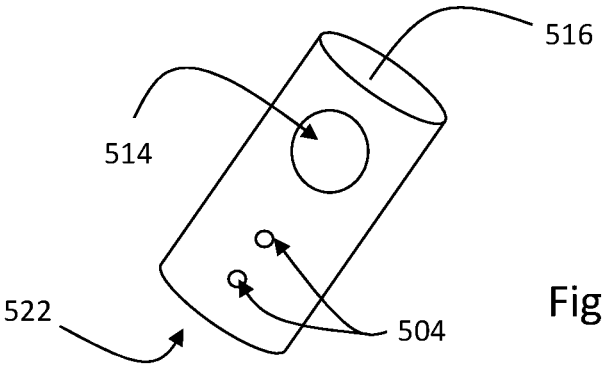

FIGS. 5A-5C illustrate embodiments of a hitch 122. The hitch 122 is attached to the second end 106 of the shaft 102, which is opposite to the spearhead 110. The hitch 122 includes a flat end, which is configured as a ram surface 516 for receiving a puncture force application (e.g., push force). The hitch 122 includes a hole, such as the hitch aperture 514, for receiving a breach force or pulling force. The hitch aperture 514 can be about 1.6 inches in cross-dimension (e.g., diameter when circular) to account for any number of generic attachments that can contribute to pulling forces, such as for removing the door. However, the hitch aperture 514 can be available in a range of dimensions. The hitch aperture 514 can allow for the hitch 122 to be coupled with a tow chain, strap, or rope that is attached to a vehicle or other device that can generate the pull force. The hitch 122 includes a mounting member 502 that is adapted to be mounted to the second end 106 of the shaft 102. The mounting member 502 extends from the second end 106 of the shaft 102 toward the first end 104 of the shaft 102. The mounting member 502 can include at least one mounting aperture 504 that is aligned with at least one end aperture 506 at the second end 106 with at least one mounting fastener 508 extending through the at least one mounting aperture 504 and the at least one end aperture 506. The mounting member can include at least one mounting plate 510. The hitch 122 includes at least one hitch member 512, which can be used to hitch to a vehicle, and which can include the hitch aperture 514.

The hitch 122 can be bolted at the second end 106 that is opposite to the spearhead 110. The hitch 122 can be mounted to the shaft 102 via through holes 504 that run entirely through the hitch 122 and holes 506 of the shaft 102 at the second end 106. The bolts 508 are held in place with a corresponding number of appropriately sized nuts 518 on the other side of the hitch 122.

For example, the shaft 106 can include two laterally (e.g., vertically when the plane of rotation of the spearhead is vertical) centered through holes 506 that are sized for clearance of the bolts 508 that are approximately the same diameter of the pin 128, which is on the first end 104 of the shaft 102. These bolts 508 are sized to attach the hitch 122 to the shaft 102. The location of the hole 506 closest to the edge on the second end 106 and the tolerances between holes 506 are set to ensure that when puncture force is applied to the hitch 122 (e.g., ram surface 516) the second end 106 of the shaft 102 will be in contact with the hitch 122. That is, the terminal surface of the second end 106 contacts a buttress surface 520 of the hitch 122. This ensures the push force that is applied from the hitch 122 is applied directly through the shaft instead of through the bolts with shear.

The hitch 122 is configured to be robust because that is where the puncture force (e.g., push force) is applied in the longitudinal axial direction. The hitch 122 is a separate part and bolted on to the shaft 102 to allow for modularity and different attachments depending on the force application and door removal methods employed. That is, different uses for different types of doors can use different hitch 122 configurations or robustness. The hitch 122 includes a flat end 516, a large laterally (e.g., vertically when the plane of rotation of the spearhead is vertical) centered hole (e.g., hitch aperture 514), and an open slot 522 defined by the mounting plates 510. Each mounting plate 510 includes two vertically centered through holes 504 (e.g., longitudinally aligned through holes 504, which are centered with respect to a lateral axis of the shaft). The flat end 516 is for ease of use and evenly distributed generic force application, such as a battering ram or post rammer 800. The large hole for the hitch aperture 514 is to account for generic attachments that contribute to pulling/removing the door, such as a hitch with a tow chain, strap or rope attached to a vehicle. The slot 522 is to encompass the second end 106 of the shaft 102 and attach to it with the bolts 508. The location and tolerances of the through holes 504 with respect to the length of the slot 522 are set to ensure that when puncture force is applied to the hitch 122, the second end 106 of the shaft 102 will be in contact with the hitch 122. Discussed previously, this ensures the force is applied from the hitch 122 directly through the shaft 102 longitudinally instead of through the bolts 508 with shear. The hitch material can be steel, or ideally corrosion resistant with reasonable tooling properties.

In some embodiments, the at least one hitch member 512 is configured to be hitched to an object. In some aspects, the object is a vehicle or mechanical device. The at least one hitch member 512 includes a hitch aperture 514 for coupling to the object, such as through a traditional hitching or coupling mechanism to a tow rope, strap, or cable. The at least one hitch member 512 includes a ram surface 516 (e.g., which is the flat surface). The at least one mounting fastener 508 includes a bolt that is fastened to a nut 518.

As shown in FIGS. 1A-1C, at least one handle 150 is mounted to the shaft 102. While only one handle 150 is shown, two handles could be mounted, such as at side regions or at various angles around the circumference of the shaft 102. The at least one handle 150 can be mounted on a top half or top hemisphere of the shaft 102. In some aspects, at least one handle 150 can be aligned with a rotational plane of the spearhead 110. Each handle 150 can be elongate and have two down bars with ends mounted spaced apart on the shaft 102. However, a handle 150 may include only one bar connected to the shaft 102, or may include more than two bars connected to the shaft 102 depending on the design of the handle. Any type of handle may be used as the handle 150 for the shaft 102. In some aspects, at least two handles 150 are mounted on a top half or top hemisphere of the shaft 102. The one of more handles 150 can be welded or otherwise mounted to the shaft 102 in an upward orientation with respect to gravity when the shaft 102 is horizontal.

In some embodiments, the handle 150 is welded (or otherwise mounted) to the shaft 102 in a location that ensures a sufficient longitudinal distance between the back end 113 of the spearhead 110 and the front end 151 of the handle 150 to allow full penetration and deployment of the spearhead 110. The distance from the spearhead 110 to the handle 150 is about 10 inches, but can vary depending on the use and configuration of the tool (e.g., 5 inches to 25 inches, 6 inches to 20 inches, 7 inches to 15 inches, or about 10 inches. Thus, the handle 150 functions as the stopping mechanism for the restraint 120 and door, as well as a means to safely hold the door breach device 100 in place while the puncturing procedure occurs, or to swing the door breach device 100 through a door. The handle 150 is oriented parallel to the spearhead deployment plane (e.g., plane of rotation). The spearhead 110 rotates away from the handle 150 when deployed. The handle 150 is on the side opposite of the tip 112 when the spearhead 110 is in the deployed state.

In some embodiments, the at least one handle 150 protrudes from an outer surface of the shaft 102. The protruding distance of the handle 150 can create a dimension from a top of the handle 105 to a bottom of the shaft 102 (e.g., vertically or with respect to gravity, or laterally with respect to the longitudinal axis of the shaft 102) such that the dimension is greater than a large cross-sectional dimension of the restraint aperture 302. The restraint 120 is dimensioned and configured so that it cannot slide onto or past the at least one handle 150. The restraint 120 holds tight clearance tolerances that minimize movement pre-deployment, but also allow the restraint 120 to slide along the shaft 102 toward the handle 150 and off of the spearhead 110, allowing gravity to deploy the spearhead 110. Accordingly, the at least one handle 150 can function as a block to block sliding of the restraint 120 toward the second end 106 of the shaft 102.

The door breach device 100 can include different configurations depending on the use. The following elements illustrate configurations of a door breach device 100. In some aspects, a hitch aperture 514 includes an axis (longitudinal with respect to the direction of the hole) that is parallel with an axis of the pivot mechanism 108 (e.g., parallel with the apertures 124, 126 and pin 128). In some aspects, a rotational plane of the spearhead 110 is orthogonal with the axes of the pivot mechanism 108 and the hitch aperture 514. In some aspects, a hitch aperture 514 includes an axis that is not parallel with an axis of the pivot mechanism 108 (e.g., parallel with the apertures 124, 126 and pin 128). In some aspects, a rotational plane of the spearhead 110 is not orthogonal with the axes of the pivot mechanism 108 and the hitch aperture 514, but it can be at a different angle.

In some embodiments, the spearhead 110 and restraint 120 include two operational configurations comprising: a puncture configuration where the restraint 120 retains the spearhead 110 aligned with the shaft 102; or a breach configuration where the restraint 120 is disengaged from the spearhead 110. The spearhead 110 rotates from the puncture configuration to the breach configuration after being pushed through the door. The puncture configuration can include the shaft 102 having a longitudinal axis that is parallel of a longitudinal axis of the spearhead 110. In some aspects, the puncture configuration includes a longitudinal axis of the spearhead 110 being perpendicular with a ram surface 516 of the hitch 122. In some aspects, a region of the spearhead 110 surrounding the shaft 102 is restrained by the restraint 120. In some aspects, the restraint 120 includes a restraint aperture 302 that at least partially or fully encircles a region of the spearhead 110 surrounding the shaft 102. In the puncture configuration, the spearhead 110 is fixed and not rotatable relative to the shaft 102 by the restraint 120. Once the restraint 120 is pushed past the spearhead 110 (e.g., no longer around or restraining the spearhead 110 to the shaft 102), the spearhead 110 freely rotates to the breach configuration. The spearhead 110 is the part that punctures the door and uses gravity to deploy about a pivot point (e.g., making the tool into a "T" shape) after the restraint 120 is off on the interior side of the door. In some aspects, a greater mass of the tip-side 114 of the spearhead 110 than a smaller mass of the shaft-side 118 of the spearhead 110 allows gravity to cause rotation of the spearhead 110 from the puncture configuration to the breach configuration.

Figure 12A:
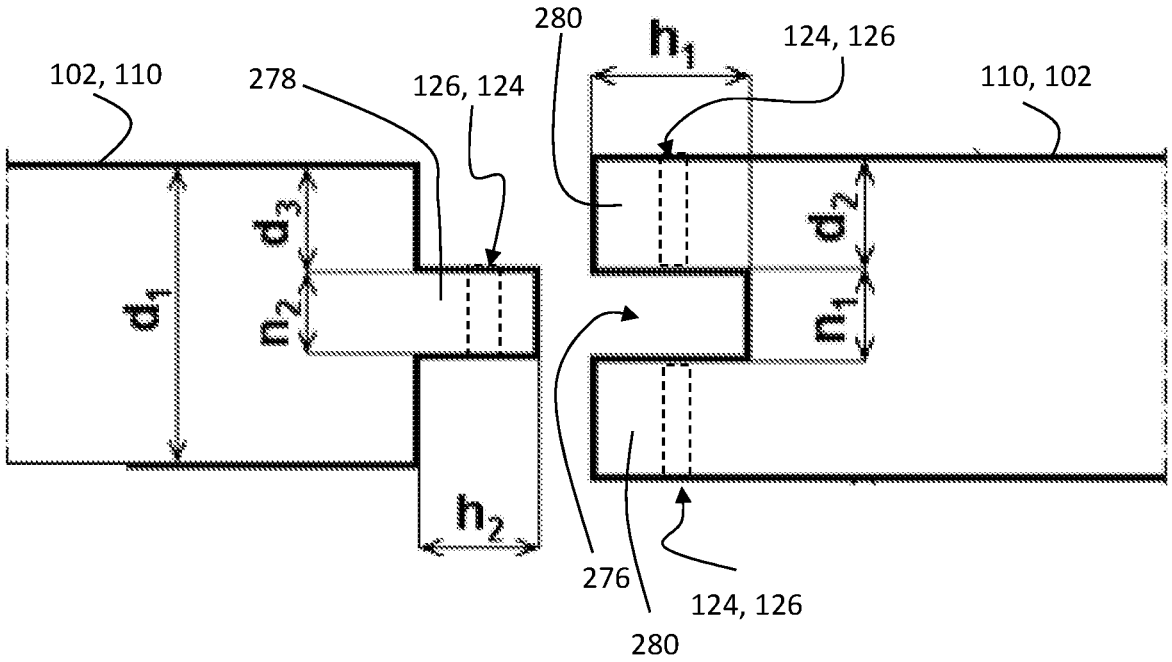
FIGS. 12A-12B show an embodiment of a connection between the shaft and spearhead that can rotate at least 90 degrees from linear in two rotational directions.
Figure 12B:
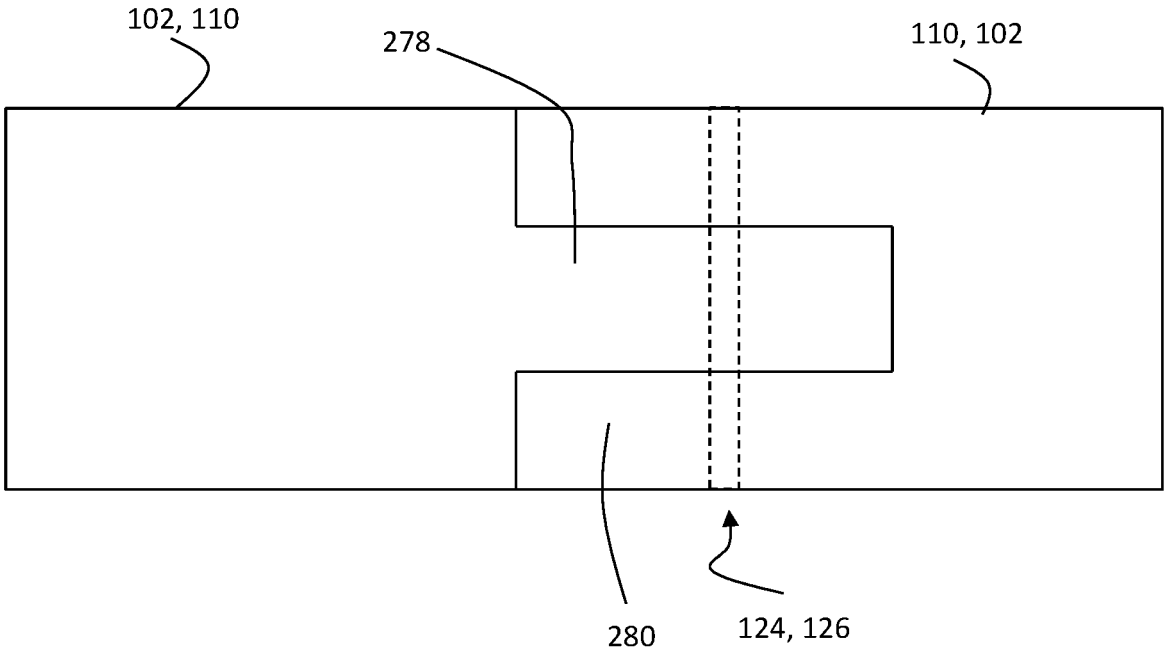

In some aspects, the shaft 102 only overlaps the spearhead 110 in a tongue-in-groove design, where either the shaft 102 or the spearhead 110 includes the groove 276 and the other includes the tongue 278 that fits into the groove 276, as shown in FIGS. 12A-12B. As such, either member can be the shaft 110 and the other the spearhead 110. The groove 276 is in a member (e.g., shaft 102 or spearhead 110) with a depth of the groove 276 being h1, cross-dimension of the groove 276 being n1, and cross-dimension of the brace 280 being d2. The tongue 278 protrudes from the other member (e.g., spearhead 110 or shaft 102) with a length of the tongue 278 being h2, cross-dimension of the tongue 278 being n2, the total cross-dimension of the member being d1, and the dimension from the tongue 278 to outer surface being d3. The braces 280 of the groove 276 includes the hole 124 or 126, and the tongue 278 includes the other hole 126 or 124, so that when the tongue 278 is in the groove 276, the holes 124, 126 are aligned. The pin 128 can be inserted through the holes 124, 126 to provide the pivot point. The ends of the braces 280 can be rounded to facilitate rotation. Similarly, the shoulders from which the tongue 278 extends can also be rounded to facilitate rotation. The weight distribution of the spearhead 110 can be modulated by modulating the length h1 and depth h2. In some instances, the tip-side 114 weighs more or has more mass so that the tip 112 drops from gravity once the restraint is removed from the overlap region of the shaft 102 and spearhead 110 when rotation occurs. In some instances, the shaft-side 118 weighs more or has more mass so that the tip 112 lifts from gravity pulling the shaft-side 118 down once the restraint is removed from the overlap region of the shaft 102 and the spearhead 110 when rotation occurs. Accordingly, the coupling embodiment of FIGS. 12A-12B can be applied to any of the breach device embodiments described herein.

Figure 13:
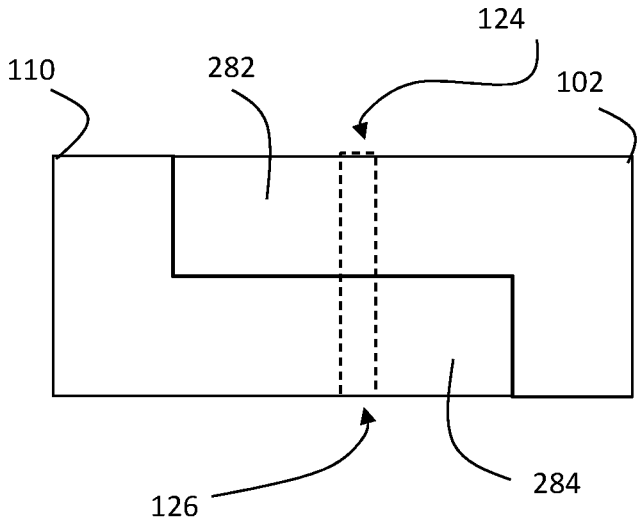
FIG. 13 shows an embodiment of a connection between the shaft and spearhead that can rotate at least 90 degrees from linear in two rotational directions.

FIG. 13 shows another embodiment of the rotational coupling where the shaft 102 includes a shaft arm 282 that has the hole 124 therein. The spearhead 110 includes a spearhead arm 284 that has the hole 126 therein. The shaft arm 282 is rotational relative to the spearhead arm 284 when the pin 128 extends through the holes 124, 126, to provide the pivot point. The shoulders and the arm ends can be rounded (chamfered) to allow for rotation of the spearhead 110 relative to the shaft 102. The restraint can be placed at the overlap region as described herein to retain the longitudinal alignment of the shaft 102 and the spearhead 110. The restraint can be thick, such as a tube, or elongated polygon, to cover the overlap region of the shaft arm 282 and spearhead arm 284 to inhibit rotation. Once the restraint is removed from around the overlap region, the spearhead 110 can rotate relative to the shaft 102. The direction of rotation can be so that the tip 112 of the spearhead is down when the tip-side 114 weighs more or has more mass so that the tip 112 drops from gravity once the restraint is removed from the overlap region of the shaft 102 and spearhead 110 when rotation occurs. In some instances, the shaft-side 118 weighs more or has more mass so that the tip 112 lifts from gravity pulling the shaft-side 118 down once the restraint is removed from the overlap region of the shaft 102 and the spearhead 110 when rotation occurs. Accordingly, the coupling embodiment of FIG. 13 can be applied to any of the breach device embodiments described herein.

In some embodiments, either the shaft 102 or the spearhead 110 can have a smaller cross-dimension (e.g., lateral dimension) so that the other extends out laterally to form a shelf.

In some embodiments, when the door breach device 100 is in the puncture configuration, a longitudinal axis of the spearhead 110 is aligned with a longitudinal axis of the shaft 102. Alternatively, when the door breach device 100 is in the breach configuration, a longitudinal axis of the spearhead 110 is at an angle with respect to a longitudinal axis of the shaft 102. The spearhead 110 is held in an undeployed position parallel to the shaft 102 with a restraint 120 that encompasses and contacts both the spearhead 110 and the shaft 102. This is accomplished by a straight edge that spans the spearhead channel 116 that has a thicker section inside the channel 116 to contact the recessed shaft 102. In some instances, a longitudinal axis of the spearhead 110 is at an angle with respect to a longitudinal axis of the shaft 102, wherein the angle is between about 75 degrees and about 105 degrees, or about 80 degrees and about 100 degrees, or about 85 degrees and about 95 degrees, or about 90 degrees. In some instances, in the breach configuration, a bottom surface 412, 412*a* of the spearhead 110 is at the angle. The bottom surface 412 is an edge of the slot opening 410. In some instances, the bottom surface 412*a* is a planar region formed into a bottom side (e.g., with respect to gravity) of the second taper region 132. In some instances, the bottom surface 412 on the brace region 134 is planar and continuous with the bottom surface 412*a* on the second taper region 132. In some instances, in the breach configuration, the shaft 102 and spearhead 110 form a "T" shape.

As shown in FIG. 4, the spearhead pin aperture 126 is vertically offset (e.g., with respect to gravity, which is a lateral offset with respect to the longitudinal axis) with respect to a central longitudinal axis or a horizontal equatorial plane of the spearhead 110 and/or brace region 134. The spearhead pin aperture 126 can be in a middle region or about equidistant from an apex of the spearhead 110 and/or brace region 134 to a bottom surface 412 of the spearhead 110 and/or brace region 134. In some aspects, the spearhead pin aperture 126 can be further from an apex of the spearhead 110 and/or brace region 134 and closer to a bottom surface 412 of the spearhead 110 and/or brace region 134. In some aspects, the spearhead pin aperture 126 can be closer to an apex of the spearhead 110 and/or brace region 134 and further from a bottom surface 412 of the spearhead 110 and/or brace region 134.

The materials of the different components of the door breach device 100 can be any hard material, such as metals or metal alloys. Specific examples include steel, stainless steel, titanium, or any suitable high strength material. Depending on the functionality of the individual part, properties such as machinability, yield strength, or hardness are weighted accordingly.

Figure 7:
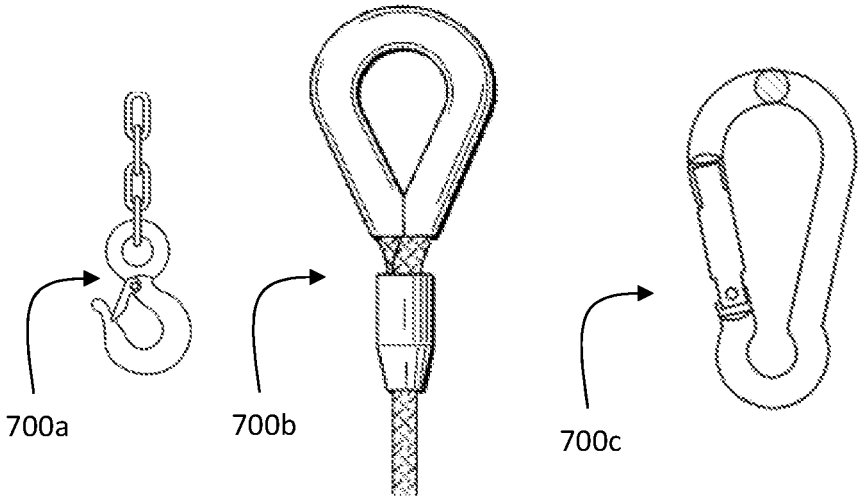
FIG. 7 illustrates different embodiments of hitch attachments.

FIG. 7 illustrates some embodiments of a tow member 700*a*, 700*b*, 700*c* that coupled to the hitch 122. The tow member 700*a* includes a hook that can be received onto the hitch aperture 514. Tow member 700*c* can be used to link tow member 700*b* to the hitch aperture 514. However, other two member configurations, with or without tow ropes, chains, straps, or cables may be coupled or couplable with the hitch aperture 514.

In some embodiments, a kit can include the door breach device of one of the embodiments, and at least one tow member 700*a*, 700*b*, 700*c*.

Figure 8:
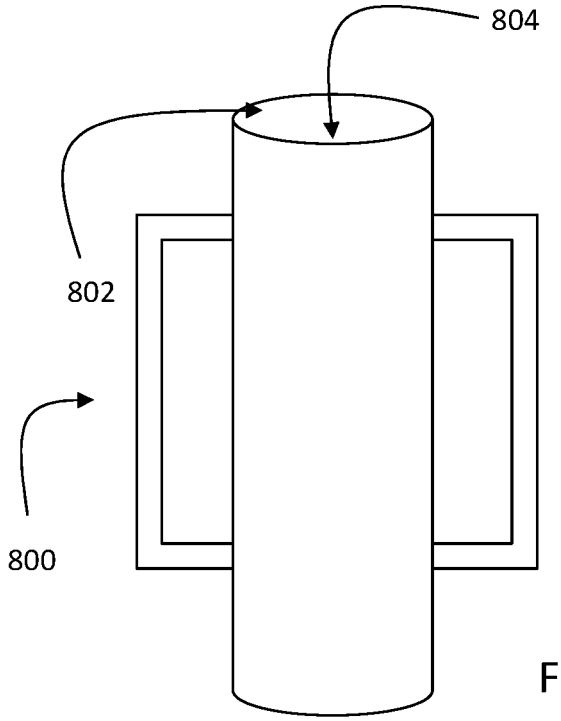
FIG. 8 illustrates an embodiment of a post rammer for use with the door breach device.

FIG. 8 illustrates a post rammer 800 that can be adapted to be received onto the hitch 122 and the shaft 102. The post rammer 800 can be received onto the hitch 122 and can ram into the ram surface 516 for the push or puncture force. FIG. 10B shows the door breach device 100*a* having the post rammer 800 thereon.

In some embodiments, a kit can include the door breach device of one of the embodiments, and a post rammer 800 having an open end 802 and internal chamber 804 adapted to be fit over the hitch 122.

Figure 6A:
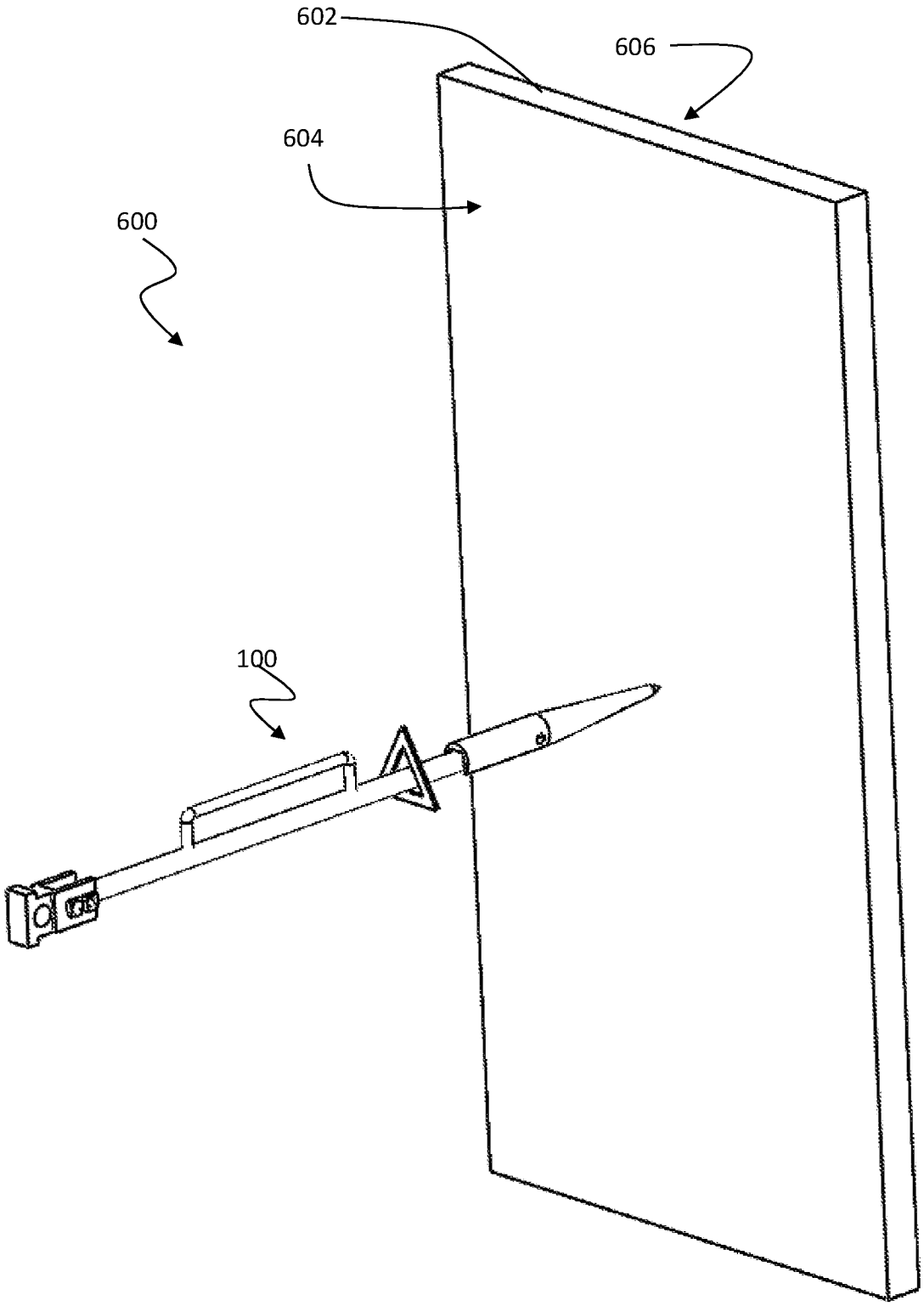
FIGS. 6A-6D illustrate stages of a method of breaching a door with the door breach device.
Figure 6B:
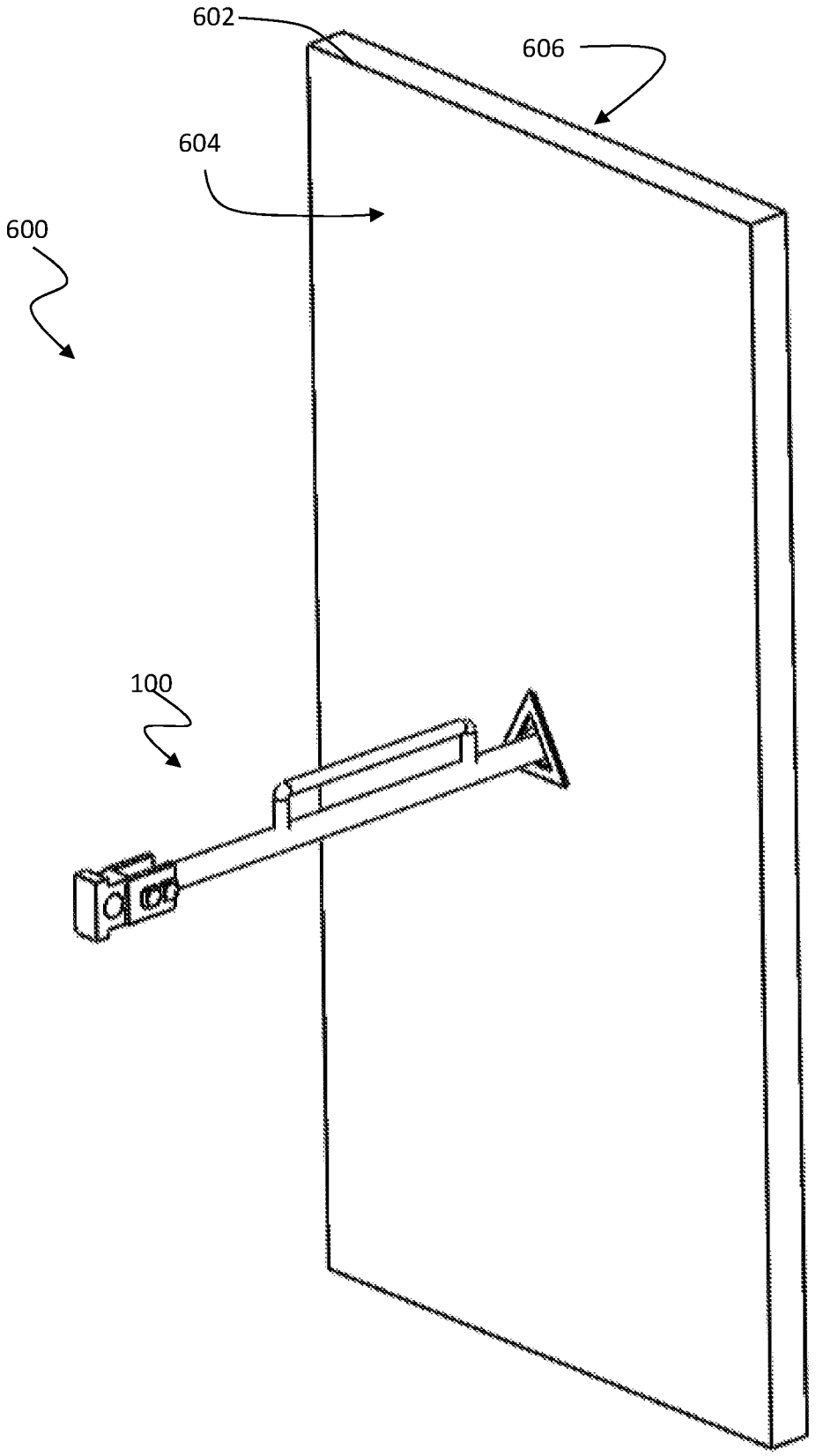
Figure 6C:
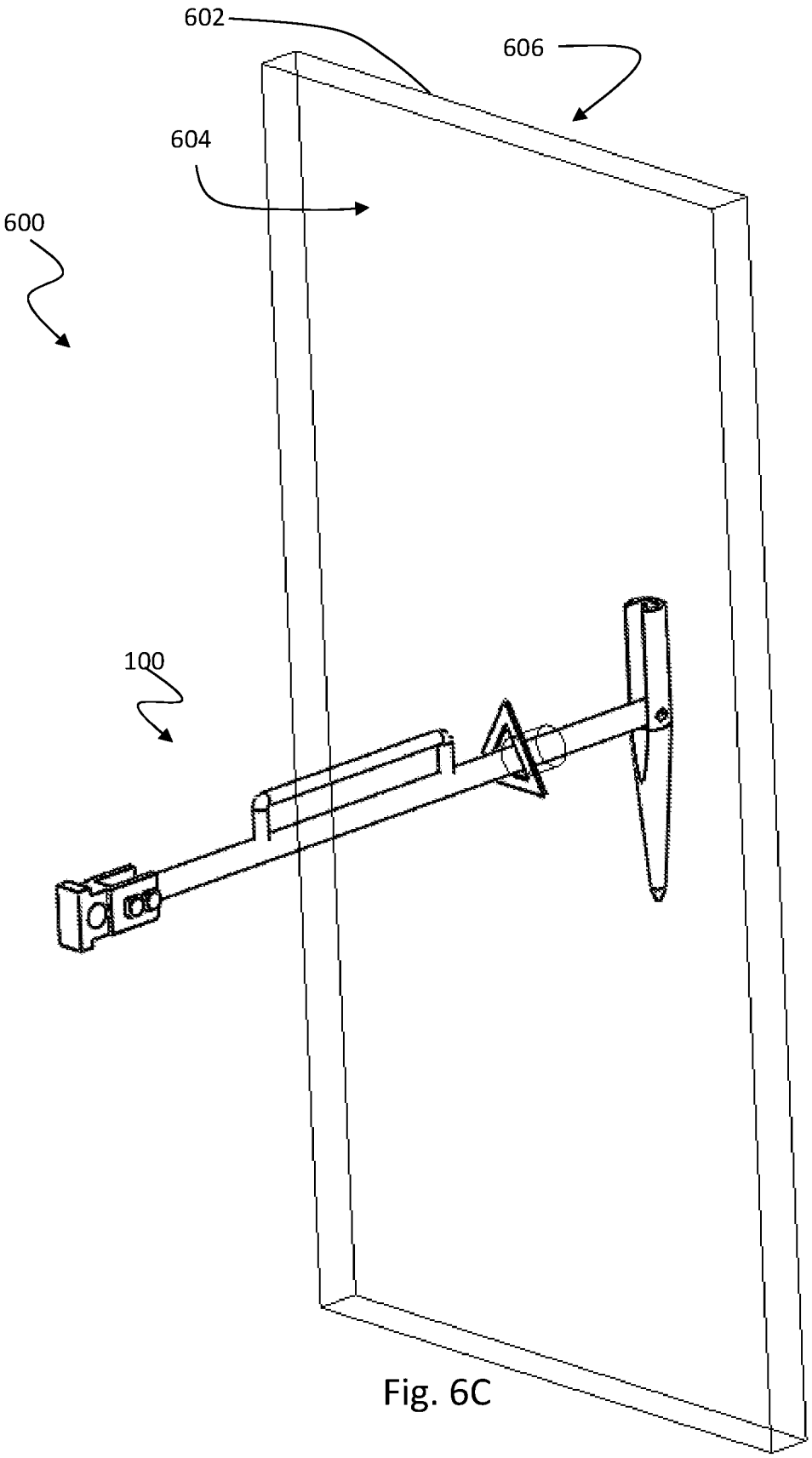
Figure 6D:
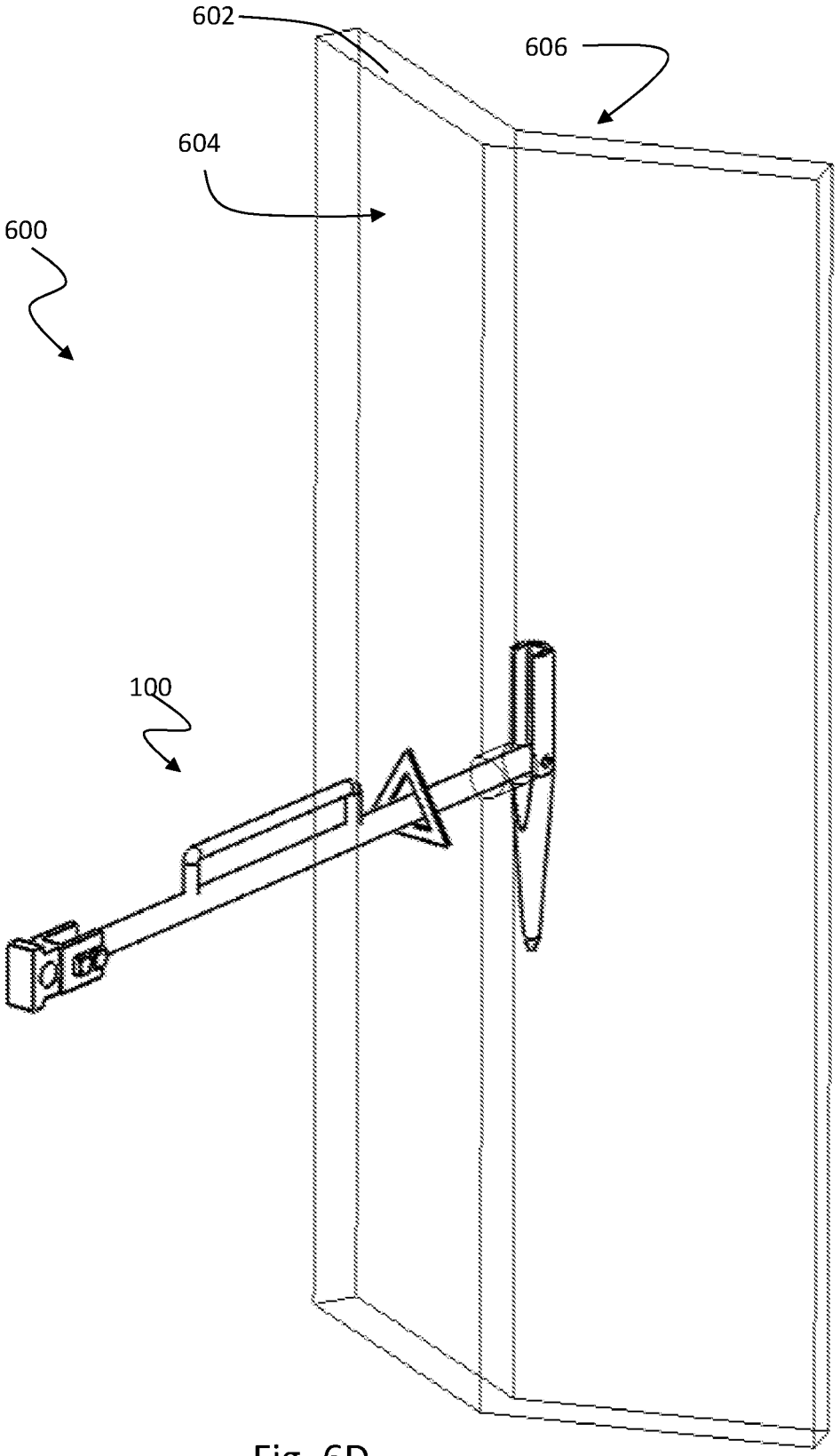

FIGS. 6A-6D show a method 600 of breaching a door 602 that can be performed with the door breach device 100. The method can include: obtaining a door breaching device 100 or kit of one of the embodiments; forcing the spearhead 110 through a first side 604 of the door 602 until the restraint 120 releases the spearhead 110 and the spearhead 110 rotates by the pivot mechanism 108 so as to form an angle with the shaft 102; and pulling the spearhead 110 against a second side 606 of the door 602 until the door 602 is breached. These figures show the functionality of the moving mechanical parts of the door breach device 100 and the general breaching procedure. FIG. 6A shows the placement of the door breach device 100 against a door 602. FIG. 6B shows how the restraint 120 can move, sliding off of the spearhead 110 toward the handle 150. FIG. 6C shows how the spearhead 110 rotates about the pivot point into its deployed state. With respect to the breaching procedure, FIG. 6A shows the initial set location of the tool with respect to a door 602, and FIG. 6B shows the puncture force location being applied to the back of the hitch 122 and the restraint 120 sliding along the shaft 102 toward the handle 150 as the spearhead 110 punctures the first side 604 of the door 602. FIG. 6C shows the deployment of the spearhead 110 into a "T" shape on other side (e.g., second side 606) of the door 602, which will occur immediately after the spearhead passes completely through the door. FIG. 6D shows the removal force location (e.g., the large hitch aperture 514 in the hitch 122), and the removal of the door 602, reacting to the force application. FIG. 6D shows the door 602 collapsing outwardly, but the door 602 may break or come off the hinges in a single piece. In any event, the door 602 is breached by the method.

The method 600 can be performed with various modifications to the technique used with the door breach device 100. In some aspect, the method 600 can include: grasping the handle 150 of the door breach device 100; and ramming the door breaching device 100 through the door 602. In some aspects, a single operator sets the door breach device 100 with the tip 112 of the restrained/undeployed spearhead 110 touching the point of puncture on a first side 604 of the door 602. In some aspects, a pushing force is applied to the hitch 122 of the door breach device 100 in the axial longitudinal direction towards the door 603. In some aspects, the spearhead 110 punctures the door 602 and continues moving in that direction, causing the restraint 120 to hit the first side 604 of the door 602 and slide towards the handle 150. In some aspects, the spearhead 110 clears the second side 606 of the punctured door 602 with a maximum clearance indicated by the door 602 or restraint 120 hitting the handle 150. In some aspects, the unrestrained spearhead 110 (e.g., with a center of gravity on the tip side of the pivot point towards the tip 112 of the first tapered end 130) uses gravity to deploy into a "T" shape. In some aspects, the operator lets go of the handle 150 and begins his next role in the breaching procedure (e.g., facilitating applying a breach or pull force. In some aspects, the pull force is applied to the hitch 122 in the axial longitudinal direction away from the door 602, wherein the pull force is sufficient to effectively open and/or remove the door 602 for a clean breach. In some aspects, the door breach device 100 is removed from the door 602 post breach operation, and the spearhead 110 is rotated back to the puncture configuration with the restraint 120 restraining rotation.

In some embodiments, the method can include: placing the tip 112 of the spearhead 110 against the first side 604 of the door 602; and applying a force to the hitch 122 to force the spearhead 110 through the door 602. In some aspects, the method can include pushing the door breaching device 100 through the door 602 until the first side 604 pushes the restraint 120 off of the spearhead 110. In some aspects, the method can include pushing the door breaching device 100 through the door 602 until the first side 604 pushes the restraint 120 to the handle 150.

In some embodiments, once the restraint is removed from the spearhead 110, the method can include listening for the spearhead 110 to rotate and hit the second side 606 of the door 602 to make an audible sound; and/or pulling on the door breaching device 100 until resisted by the second side 606 of the door 602 stopping the spearhead 110.

Figure 11A:
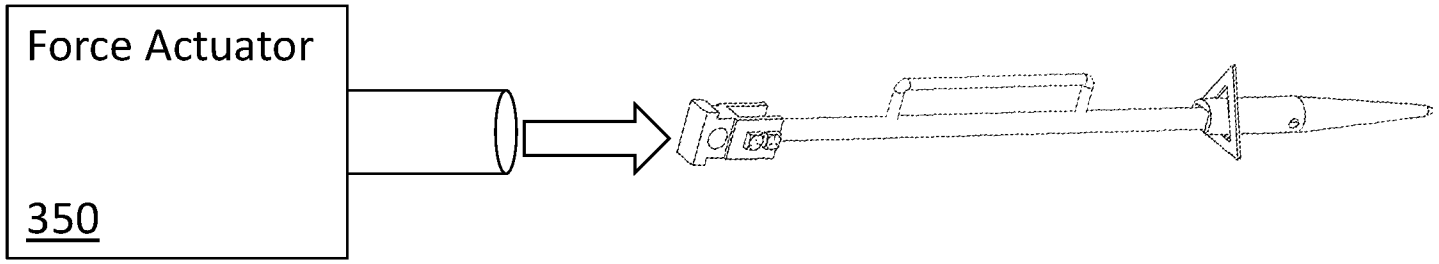
FIG. 11A illustrates a force actuator providing a push force to the door breach device.
Figure 11B:
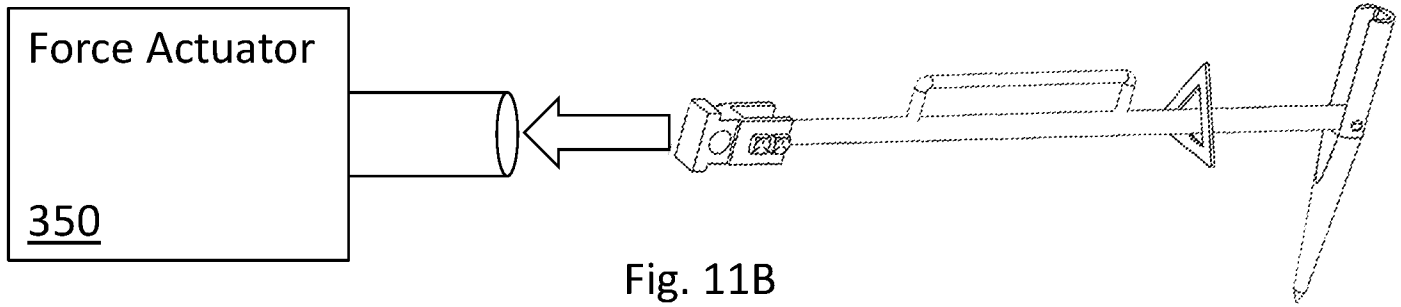
FIG. 11B illustrates a force actuator providing a pull force to the door breach device.

In some embodiments, the method can include applying a force to the hitch 122 to force the spearhead 110 through the door 602 by a human force, mechanical force, pneumatic force, or the like. In some aspects, the force is applied to the hitch 122 by a force actuator 350, such as shown in FIGS. 11A-11B. In some aspects, the force actuator 350 applies a pushing force to push the spearhead 110 through the door 602 (e.g., FIG. 11A). In some aspects, the force actuator 350 applies a pulling force to pull the spearhead 110 through the door 602 (e.g., FIG. 11B). In some aspects, the force actuator 350 includes an arm 252 that applies the force to the hitch 122. In some aspects, the arm 252 is flexible (tow strap, rope, cord, cable) when used for a pulling force or is rigid (drive shaft or rod) when used for a pulling force and/or for a pushing force.

In some embodiments, the method includes removing the breaching device 100 from the door 602 after the door 602 is breached. In some aspects, the removing includes: aligning the spearhead 110 with the shaft 102; and applying a force to the breaching device 100 to extract the breaching device from the door 602. In some aspects, the force to remove the door breach device 100 is a pulling force applied to the hitch 122 or a pushing force applied to the spearhead 110.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

All references recited herein are incorporated herein by specific reference in their entirety.

The invention claimed is:

1. A door breach device comprising:

an elongate shaft having a first end region and an opposite second end region;

a pivot mechanism at the first end region;

a spearhead having a shaft side rotatably coupled to the first end region of the elongate shaft with the pivot mechanism, wherein the spearhead has a tip on a tip side and the spearhead has a shaft cavity on a shaft side, where the shaft cavity is adapted to receive the shaft therein, the shaft cavity having a top wall thereby the spearhead only being rotatable in one rotational direction from aligned with shaft to an angle with the top wall inhibiting rotation in an opposite rotational direction when the spearhead is aligned with the shaft;

a restraint configured to be slidably received on a shaft side of the spearhead and on the shaft to stop rotation of the spearhead relative to the elongate shaft; and an end member coupled to the second end region of the shaft.

2. The device of claim 1, further comprising the restraint being slidably received on the shaft side of the spearhead and on the shaft when received into the shaft cavity.

3. The device of claim 1, further comprising:

the elongate shaft having the first end with a tongue or groove;

the spearhead rotatably coupled with the pivot mechanism by having the other of the tongue or groove to form a rotatable tongue-in-groove coupling, the spearhead having the tongue or groove on a shaft side, where the groove is adapted to receive the tongue therein; and the restraint configured to be slidably received over an overlap region where the shaft overlaps with the spearhead in the tongue-in-groove coupling.

4. The door breach device of claim 1, wherein:

the first end of the shaft includes a shaft pin aperture;

the spearhead includes at least one spearhead pin aperture; and a pin is located in the shaft pin aperture and the at least one spearhead pin aperture so as to form the pivot mechanism.

5. The door breach device of claim 4, wherein the spearhead pin aperture is vertically offset with respect to a central longitudinal axis or a horizontal equatorial plane of the spearhead.

6. The door breach device of claim 1, wherein the spearhead includes more mass on the tip side than on the shaft side relative to the pivot mechanism.

7. The door breach device of claim 1, wherein the restraint includes a plate body having a restraint aperture, wherein the spearhead and/or shaft is received through the restraint aperture, wherein the restraint aperture includes at least one aperture spearhead surface slidably contacting the spearhead and/or contacting the shaft.

8. The door breach device of claim 1, wherein a body of the restraint includes at least one push surface that is at an angle relative to a longitudinal axis of the shaft, and the restraint aperture is defined by the restraint having a protruding region protruding into the restraint aperture.

9. The door breach device of claim 1, wherein the end member includes a mounting member that is mounted to the second end of the shaft.

10. The door breach device of claim 9, wherein the mounting member includes at least one mounting aperture that is aligned with at least one end aperture at the second end with at least one mounting fastener extending through the at least one mounting aperture and the at least one end aperture.

11. The door breach device of claim 1, further comprising at least one handle mounted to a middle region of the shaft, the at least one handle protruding laterally from the middle region of the shaft.

12. The door breach device of claim 11, wherein the at least one handle protrudes from the shaft, wherein the protruding distance of the handle creates a dimension from a top of the handle to a bottom of the shaft such that the dimension is greater than a largest cross-sectional dimension of a restraint aperture of the restraint, wherein the at least one handle functions as a block to block sliding of the restraint toward the second end of the shaft.

13. The door breach device of claim 11, further comprising at least two handles members mounted to a middle region of the shaft, the at least two handle members protruding laterally from the middle region of the shaft.

14. The door breach device of claim 1, wherein the spearhead and restraint include two operational configurations comprising:

a puncture configuration where the restraint retains the spearhead aligned with the shaft; or a breach configuration where the restraint is disengaged from the spearhead.

15. The door breach device of claim 14, wherein in the puncture configuration the spearhead is fixed and not rotatable relative to the shaft by the restraint, wherein once the restraint is pushed past the spearhead to the shaft, the spearhead freely rotates to the breach configuration.

16. The device of claim 1, wherein each of the elongate shaft and spearhead has a square or rectangular cross-sectional profile.

17. The device of claim 1, wherein the tip is a tip member that is removably coupled with the tip side of the spearhead.

18. A method of breaching a door, the method comprising:

obtaining the door breaching device of claim 1;

forcing the spearhead through a first side of the door until the restraint releases the spearhead and the spearhead rotates by the pivot mechanism so as to form an angle with the shaft; and pulling the spearhead against a second side of the door until the door is breached.

19. The method of claim 18, wherein the door breaching devices includes at least one handle mounted to a middle region of the shaft, the at least one handle protruding laterally from the middle region of the shaft, the method-comprising:

grasping the handle of the door breaching device; and ramming the door breaching device through the door while grasping the handle.

20. The method of claim 19, comprising: removing the breaching device from the door after the door is breached, wherein the removing includes:

aligning the spearhead with the shaft; and applying a force to the breaching device to extract the breaching device from the door, wherein the force is a pulling force applied to the end member or a handle in a middle region of the shaft or a pushing force applied to the spearhead.

21. The method of claim 18, comprising:

placing the tip of the spearhead against the first side of the door; and applying a force to the end member to force the spearhead through the door.

22. The method of claim 18, comprising pushing the door breaching device through the door until the first side pushes the restraint off of the spearhead.

23. The method of claim 18, comprising:

once the restraint is removed from the spearhead, listening for the spearhead to rotate and hit the second side of the door to make an audible sound; and/or pulling on the door breaching device until resisted by the second side of the door stopping the spearhead.

24. The method of claim 18, comprising applying a force to the end member to force the spearhead through the door.

25. The method of claim 24, wherein the force is applied to the end member by a force actuator, the force actuator applies a pushing force to push the spearhead through the door, and the force actuator applies a pulling force to pull the spearhead through the door.

26. A door breach device comprising:

an elongate shaft having a first end region and an opposite second end region;

a pivot mechanism at the first end region;

a spearhead having a shaft side rotatably coupled to the first end region of the elongate shaft with the pivot mechanism, wherein the spearhead has a tip on a tip side;

a restraint configured to be slidably received on a shaft side of the spearhead and on the shaft to stop rotation of the spearhead relative to the elongate shaft;

at least two handles mounted to the shaft, the at least two handles protruding from the shaft; and an end member coupled to the second end region of the shaft.

27. A method of breaching a door, the method comprising:

obtaining the door breaching device of claim 26;

forcing the spearhead through a first side of the door while holding the at least two handles until the restraint releases the spearhead and the spearhead rotates by the pivot mechanism so as to form an angle with the shaft; and pulling the spearhead against a second side of the door while holding the at least two handles until the door is breached.

* * * * *